US010629425B2

(12) United States Patent
Hoyes et al.

(10) Patent No.: US 10,629,425 B2
(45) Date of Patent: Apr. 21, 2020

(54) IMAGING MASS SPECTROMETER

(71) Applicants: Micromass UK Limited, Wilmslow (GB); LECO CORPORATION, St. Joseph, MI (US)

(72) Inventors: John Brian Hoyes, Stockport (GB); Anatoly Verenchikov, Montenegro (RU); Mikhail Yavor, St. Petersburg (RU); Keith Richardson, New Mills-High Peak (GB); Jason Wildgoose, Stockport (GB)

(73) Assignees: MICROMASS UK LIMITED, Wilmslow (GB); LECO CORPORATION, St. Joseph, MI (US)

( * ) Notice: Subject to any disclaimer, the term of this patent is extended or adjusted under 35 U.S.C. 154(b) by 0 days.

(21) Appl. No.: 15/776,585

(22) PCT Filed: Nov. 16, 2016

(86) PCT No.: PCT/US2016/062174
§ 371 (c)(1),
(2) Date: May 16, 2018

(87) PCT Pub. No.: WO2017/087456
PCT Pub. Date: May 26, 2017

(65) Prior Publication Data

US 2018/0330936 A1 Nov. 15, 2018

(30) Foreign Application Priority Data

Nov. 16, 2015 (GB) ..... 1520130.4

(51) Int. Cl.
*H01J 49/40* (2006.01)
*H01J 49/00* (2006.01)
(Continued)

(52) U.S. Cl.
CPC ..... *H01J 49/405* (2013.01); *H01J 49/0004* (2013.01); *H01J 49/009* (2013.01);
(Continued)

(58) Field of Classification Search
USPC ..... 250/287, 281, 282
See application file for complete search history.

(56) References Cited

U.S. PATENT DOCUMENTS 4,731,532 A 3/1988 Frey et al.
5,017,780 A 5/1991 Kutscher et al.
(Continued)

FOREIGN PATENT DOCUMENTS

CN 101369510 A 2/2009
CN 102131563 A 7/2011
(Continued)

OTHER PUBLICATIONS

International Search Report and Written Opinion for International Application No. PCT/US2016/062174 dated Mar. 6, 2017.
(Continued)

*Primary Examiner* — Kiet T Nguyen

(57) ABSTRACT

A time-of-flight mass spectrometer is disclosed comprising ion optics that map an array of ions at an ion source array (71) to a corresponding array of positions on a position sensitive ion detector (79). The ion optics include at least one gridless ion mirror (76) for reflecting ions, which may compensate for various aberrations and allows the spectrometer to have relatively high mass and spatial resolutions.

19 Claims, 11 Drawing Sheets

(51) Int. Cl.

| | |
|---|---|
| ***H01J 49/10*** | (2006.01) |
| ***H01J 49/06*** | (2006.01) |
| *H01J 49/46* | (2006.01) |

(52) U.S. Cl.

CPC ..... *H01J 49/062* (2013.01); *H01J 49/067* (2013.01); *H01J 49/10* (2013.01); *H01J 49/107* (2013.01); *H01J 49/406* (2013.01); *H01J 49/46* (2013.01)

(56) References Cited

U.S. PATENT DOCUMENTS 5,128,543 A 7/1992 Reed et al.
5,619,034 A 4/1997 Reed et al.
5,654,544 A 8/1997 Dresch
5,955,730 A 9/1999 Kerley et al.
6,013,913 A 1/2000 Hanson
6,020,586 A 2/2000 Dresch et al.
6,107,625 A 8/2000 Park
6,316,768 B1 11/2001 Rockwood et al.
6,384,410 B1 5/2002 Kawato
6,469,295 B1 10/2002 Park
6,489,610 B1 12/2002 Barofsky et al.
6,570,152 B1 5/2003 Hoyes
6,627,877 B1 9/2003 Davis et al.
6,717,132 B2 4/2004 Franzen
6,744,042 B2 6/2004 Zajfman et al.
6,888,130 B1 5/2005 Gonin
6,949,736 B2 9/2005 Ishihara
7,034,292 B1 4/2006 Whitehouse et al.
7,196,324 B2 3/2007 Verentchikov
7,326,925 B2 2/2008 Verentchikov et al.
7,351,958 B2 4/2008 Vestal
7,385,187 B2 6/2008 Verentchikov et al.
7,501,621 B2 3/2009 Willis et al.
7,504,620 B2 3/2009 Sato et al.
7,582,864 B2 9/2009 Verentchikov
7,663,100 B2 2/2010 Vestal
7,709,789 B2 5/2010 Vestal et al.
7,772,547 B2 8/2010 Verentchikov
7,825,373 B2 11/2010 Willis et al.
7,863,557 B2 1/2011 Brown
7,884,319 B2 2/2011 Willis et al.
7,932,491 B2 4/2011 Vestal
7,982,184 B2 7/2011 Sudakov
7,989,759 B2 8/2011 Holle
8,017,907 B2 9/2011 Willis et al.
8,063,360 B2 11/2011 Willis et al.
8,395,115 B2 3/2013 Makarov et al.
8,637,815 B2 1/2014 Makarov et al.
8,642,951 B2 2/2014 Li
8,658,984 B2 2/2014 Makarov et al.
8,853,623 B2 10/2014 Verenchikov
8,921,772 B2 12/2014 Verenchikov
9,082,597 B2 7/2015 Willis et al.
9,082,604 B2 7/2015 Verenchikov
9,214,322 B2 12/2015 Kholomeev et al.
9,312,119 B2 4/2016 Verenchikov
9,373,490 B1 6/2016 Nishiguchi
9,396,922 B2 7/2016 Verenchikov et al.
9,425,034 B2 8/2016 Verentchikov et al.
9,472,390 B2 10/2016 Verenchikov et al.
9,595,431 B2 3/2017 Verenchikov
9,683,963 B2 6/2017 Verenchikov
9,728,384 B2 8/2017 Verenchikov
9,779,923 B2 10/2017 Verenchikov
9,786,484 B2 10/2017 Willis et al.
9,865,445 B2 1/2018 Verenchikov et al.
9,870,906 B1 1/2018 Quarmby
9,881,780 B2 1/2018 Verenchikov et al.
2001/0011703 A1* 8/2001 Franzen ..... H01J 49/00 250/287
2002/0190199 A1* 12/2002 Li ..... H01J 49/00 250/287
2003/0111597 A1 6/2003 Gonin et al.
2004/0084613 A1 5/2004 Bateman et al.
2004/0108453 A1 6/2004 Kobayashi et al.
2004/0119012 A1 6/2004 Vestal
2004/0155187 A1 8/2004 Axelsson
2005/0040326 A1 2/2005 Enke
2005/0103992 A1 5/2005 Yamaguchi et al.
2005/0258364 A1 11/2005 Whitehouse et al.
2006/0169882 A1 8/2006 Pau et al.
2006/0214100 A1* 9/2006 Verentchikov et al. ..... H01J 49/40 250/287
2006/0289746 A1 12/2006 Raznikov et al.
2007/0023645 A1 2/2007 Chernushevich
2007/0029473 A1 2/2007 Verentchikov
2007/0176090 A1* 8/2007 Verentchikov ..... H01J 49/00 250/287
2007/0187614 A1 8/2007 Schneider et al.
2007/0194223 A1 8/2007 Sato et al.
2008/0049402 A1 2/2008 Han et al.
2008/0197276 A1 8/2008 Nishiguchi et al.
2008/0290269 A1 11/2008 Saito et al.
2009/0272890 A1 11/2009 Ogawa et al.
2010/0072363 A1 3/2010 Giles et al.
2010/0140469 A1 6/2010 Nishiguchi
2010/0193682 A1 8/2010 Golikov
2010/0301202 A1 12/2010 Vestal
2011/0133073 A1 6/2011 Sato et al.
2011/0168880 A1 7/2011 Ristroph et al.
2011/0180705 A1 7/2011 Yamaguchi
2011/0186729 A1 8/2011 Verentchikov et al.
2012/0168618 A1 7/2012 Vestal
2012/0261570 A1* 10/2012 Shvartsburg et al. .. H01J 49/40 250/287
2013/0048852 A1 2/2013 Verenchikov
2013/0056627 A1 3/2013 Verenchikov
2013/0068942 A1 3/2013 Verentchikov
2013/0187044 A1 7/2013 Ding et al.
2013/0240725 A1 9/2013 Makarov
2013/0248702 A1 9/2013 Makarov
2013/0313424 A1 11/2013 Makarov
2013/0327935 A1 12/2013 Wiedenbeck
2014/0054456 A1 2/2014 Kinugawa et al.
2014/0084156 A1 3/2014 Ristroph
2014/0117226 A1 5/2014 Giannakopulos
2014/0138538 A1 5/2014 Hieftje et al.
2014/0183354 A1 7/2014 Moon et al.
2014/0239172 A1 8/2014 Makarov
2014/0291503 A1 10/2014 Shchepunov et al.
2014/0361162 A1 12/2014 Murray et al.
2015/0028197 A1 1/2015 Grinfeld et al.
2015/0028198 A1 1/2015 Grinfeld et al.
2015/0048245 A1 2/2015 Vestal et al.
2015/0122986 A1 5/2015 Haase
2015/0279650 A1 10/2015 Verenchikov
2015/0294849 A1 10/2015 Makarov et al.
2015/0380233 A1* 12/2015 Verenchikov ..... H01J 49/40 250/287
2016/0079052 A1 3/2016 Maakarov
2016/0225598 A1 8/2016 Ristroph
2016/0225602 A1 8/2016 Ristroph et al.
2016/0240363 A1 8/2016 Verenchikov
2017/0025265 A1 1/2017 Verenchikov et al.
2017/0032952 A1 2/2017 Verenchikov
2017/0098533 A1 4/2017 Stewart et al.
2017/0338094 A1 11/2017 Verentchikov

FOREIGN PATENT DOCUMENTS

DE 10116536 A 10/2002
EP 0237259 A2 9/1987
EP 1137044 A2 9/2001
EP 2068346 A2 6/2009
EP 2599104 A1 6/2013
GB 2080021 A 1/1982
GB 2080021 B 11/1984
GB 2217907 A 11/1989
GB 2390935 A 1/2004
GB 2403063 A 12/2004

(56) References Cited

FOREIGN PATENT DOCUMENTS

| | | | |
|---|---|---|---|
| GB | 2396742 | B | 12/2005 |
| GB | 2455977 | A | 7/2009 |
| GB | 2478300 | A | 9/2011 |
| GB | 2489094 | A | 9/2012 |
| GB | 2490571 | A | 11/2012 |
| GB | 2495127 | A | 4/2013 |
| GB | 2495221 | A | 4/2013 |
| GB | 2496991 | A | 5/2013 |
| GB | 2496994 | A | 5/2013 |
| GB | 2501332 | A | 10/2013 |
| GB | 2506362 | A | 4/2014 |
| GB | 2528875 | A | 2/2016 |
| GB | 2555609 | A | 5/2018 |
| GB | 2556451 | A | 5/2018 |
| JP | 2003031178 | A | 1/2003 |
| JP | 3571546 | B2 | 9/2004 |
| JP | 2005538346 | A | 12/2005 |
| JP | 2006049273 | A | 2/2006 |
| JP | 2007227042 | A | 9/2007 |
| JP | 2010062152 | A | 3/2010 |
| JP | 4649234 | B2 | 3/2011 |
| JP | 2015506567 | A | 3/2015 |
| RU | 2564443 | C2 | 10/2015 |
| RU | 2015148627 | A | 5/2017 |
| RU | 2660655 | C2 | 7/2018 |
| SU | 1725289 | A1 | 4/1992 |
| WO | 1998001218 | A1 | 1/1998 |
| WO | 2000/77823 | A2 | 12/2000 |
| WO | 2005001878 | A2 | 1/2005 |
| WO | 2006102430 | A2 | 9/2006 |
| WO | 2007044696 | A1 | 4/2007 |
| WO | 2007/104992 | A1 | 9/2007 |
| WO | 2007/136373 | A1 | 11/2007 |
| WO | 2010008386 | A1 | 1/2010 |
| WO | 2013045428 | A1 | 3/2011 |
| WO | 2011086430 | A1 | 7/2011 |
| WO | 2011107836 | A1 | 9/2011 |
| WO | 2011135477 | A1 | 11/2011 |
| WO | 2012/010894 | A1 | 1/2012 |
| WO | 2012024468 | A2 | 2/2012 |
| WO | 2012116765 | A1 | 9/2012 |
| WO | 2013063587 | A2 | 5/2013 |
| WO | 2013093587 | A1 | 6/2013 |
| WO | 2013098612 | A1 | 7/2013 |
| WO | 2013110587 | A2 | 8/2013 |
| WO | 2013110588 | A2 | 8/2013 |
| WO | 2013124207 | A | 8/2013 |
| WO | 2014074822 | A1 | 5/2014 |
| WO | 2014110697 | A1 | 7/2014 |
| WO | 2014142897 | A1 | 9/2014 |
| WO | 2015142897 | A1 | 9/2015 |
| WO | 2015/153630 | A1 | 10/2015 |
| WO | 2015152968 | A1 | 10/2015 |
| WO | 2015153644 | A1 | 10/2015 |
| WO | 2016064398 | A1 | 4/2016 |
| WO | 2016174462 | A1 | 11/2016 |
| WO | 2018/073589 | A1 | 4/2018 |
| WO | 2019/030476 | A1 | 2/2019 |

OTHER PUBLICATIONS

Search Report for GB Application No. GB1520130.4 dated May 25, 2016.

Search Report for United Kingdom Application No. GB1613988.3 dated Jan. 5, 2017, 5 pages.

Sakurai et al., "A New Multi-Passage Time-of-Flight Mass Spectrometer at JAIST", Nuclear Instruments & Methods in Physics Research, Section A, Elsevier, 427(1-2): 182-186, May 11, 1999.

Toyoda et al., "Multi-Turn-Time-of-Flight Mass Spectometers with Electrostatic Sectors", Journal of Mass Spectrometry, 38: 1125-1142, Jan. 1, 2003.

Wouters et al., "Optical Design of the TOFI (Time-of-Flight Isochronous) Spectrometer for Mass Measurements of Exotic Nuclei", Nuclear Instruments and Methods in Physics Research, Section A, 240(1): 77-90, Oct. 1, 1985.

Stresau, D., et al.: "Ion Counting Beyond 10ghz Using a New Detector and Conventional Electronics", European Winter Conference on Plasma Spectrochemistry, Feb. 4-8, 2001, Lillehammer, Norway, Retrieved from the Internet:URL:https://www.etp-ms.com/file-repository/21 [retrieved on Jul. 31, 2019].

Kaufmann, R., et. al., "Sequencing of peptides in a time-of-flight mass spectrometer: evaluation of postsource decay ollowing matrix-assisted laser desorption ionisation (MALDI)", International Journal of Mass Spectrometry and Ion Processes, Elsevier Scientific Publishing Co. Amsterdam, NL, 131:355-385, Feb. 24, 1994.

Barry Shaulis et al: "Signal linearity of an extended range pulse counting detector: Applications to accurate and Precise U-Pb dating of zircon by laser ablation quadrupole ICP-MS", G3: Geochemistry, Geophysics, Geosystems, 11(11):1-12, Nov. 20, 2010.

Search Report for United Kingdom Application No. GB1708430.2 dated Nov. 28, 2017.

International Search Report and Written Opinion for International Application No. PCT/GB20180051320 dated Aug. 1, 2018.

International Search Report and Written Opinion for International Application No. PCT/GB2019/051839 dated Sep. 18, 2019.

International Search Report and Written Opinion for International Application No. PCT/GB2019/051234 dated Jul. 29, 2019.

Combined Search and Examination Report for United Kingdom Application No. GB1901411.7 dated Jul. 31, 2019.

Examination Report for United Kingdom Application No. GB1618980.5 dated Jul. 25, 2019.

Extended European Search Report for EP Patent Application No. 16866997.6, dated Oct. 16, 2019.

Combined Search and Examination Report for GB 1906258.7, dated Oct. 25, 2019.

Combined Search and Examination Report for GB1906253.8, dated Oct. 30, 2019.

Doroshenko, V.M., and Cotter, R.J., "Ideal velocity focusing in a reflectron time-of-flight mass spectrometer", American Society for Mass Spectrometry, 10(10):992-999 (1999).

IPRP PCT/US2016/062174 dated May 22, 2018, 6 pages.

International Search Report and Written Opinion of the International Search Authority for Application No. PCT/GB2016/051238 dated Jul. 12, 2016, 16 pages.

International Search Report and Written Opinion for International Application No. PCT/US2016/062203 dated Mar. 5, 2017, 8 pages.

Communication Relating to the Results of the Partial International Search for International Application No. PCT/GB2019/01118, dated Jul. 19, 2019, 25 pages.

Search Report for GB Application No. GB1520134.6 dated May 26, 2016.

IPRP PCT/US2016/062203, dated May 22, 2018, 6 pages.

IPRP for application PCT/GB2016/051238 dated Oct. 31, 2017, 13 pages.

International Search Report and Written Opinion for International Application No. PCT/US2016/063076 dated Mar. 30, 2017, 9 pages.

Search Report under Section 17(5) for application GB1707208.3, dated Oct. 12, 2017, 6 pages.

Search Report for GB Application No. 1520540.4 dated May 24, 2016.

IPRP for application PCT/US2016/063076, dated May 29, 2018, 7 pages.

Wikipedia, "Reflectron", Oct. 9, 2015, Retrieved from the Internet: URL:https://en.wikipedia.org/w/index.php?title=Reflectron&oldid=684843442, [retrieved on May 29, 2019].

Scherer, S., et al., "A novel principle for an ion mirror design in time-of-flight mass spectrometry", International Journal of Mass Spectrometry, Elsevier Science Publishers, Amsterdam, NL, vol. 251, No. 1, Mar. 15, 2006.

International Search Report and Written Opinion for International Application No. PCT/EP2017/070508 dated Oct. 16, 2017, 18 pages.

IPRP PCT/GB17151981 dated Jan. 8, 2019, 7 pages.

International Search Report and Written Opinion for International Application No. PCT/GB2018/051206, dated Jul. 12, 2018, 9 pages.

(56) References Cited

OTHER PUBLICATIONS

N/a: "Electrostatic lens," Wikipedia, Mar. 31, 2017 (Mar. 31, 2017), XP055518392, Retrieved from the Intemet:URL: https://en.wikipedia.org/w/index.phptitle=Electrostatic lens oldid=773161674[retrieved on Oct. 24, 2018].
Hussein, O.A. et al., "Study the most favorable shapes of electrostatic quadrupole doublet lenses" , AIP Conference Proceedings, vol. 1815, Feb. 17, 2017 (Feb. 17, 2017), p. 110003.
Supplementary Partial EP Search Report for EP Application No. 16866997.6, dated Jun. 7, 2019.
Yavor, M.I., et al., "High performance gridless ion mirrors for multi-reflection time-of-flight and electrostatic trap mass analyzers", International Journal of Mass Spectrometry, vol. 426, Mar. 2018, pp. 1-11.
Guan S., et al. "Stacked-ring electrostatic ion guide", Journal of the American Society for Mass Spectrometry, Elsevier Science Inc, 7(1)101-106 (1996).
International Search Report and Written Opinion for application No. PCT/GB2018/052104, dated Oct. 31, 2018, 14 pages.
International Search Report and Written Opinion for application No. PCT/GB2018/052105, dated Oct. 15, 2018, 18 pages.
International Search Report and Written Opinion for application PCT/GB2018/052100, dated Oct. 19, 2018, 19 pages.
International Search Report and Written Opinion for application PCT/GB2018/052102, dated Oct. 25, 2018, 14 pages.
International Search Report and Written Opinion for application No. PCT/GB2018/052103, dated Oct. 30, 2018, 16 pages.
International Search Report and Written Opinion for application No. PCT/GB2018/052101, dated Oct. 19, 2018, 15 pages.
Combined Search and Examination Report under Sections 17 and 18(3) for application GB1807605.9 dated Oct. 29, 2018, 6 pages.
Combined Search and Examination Report under Sections 17 and 18(3) for application GB18076265, dated Oct. 29, 2018, 8 pages.
International Search Report and Written Opinion for application No. PCT/GB2018/052099, dated Oct. 10, 2018, 16 pages.
Kozlov, B. et al. "Enhanced Mass Accuracy in Multi-Reflecting TOF MS" www.waters.com/posters, ASMS Conference (2017).
Kozlov, B. et al. "Multiplexed Operation of an Orthogonal Multi-Reflecting TOF Instrument to Increase Duty Cycle by Two Orders" ASMS Conference, San Diego, CA, Jun. 6, 2018.
Kozlov, B. et al. "High accuracy self-calibration method for high resolution mass spectra" ASMS Conference Abstract, 2019.
Kozlov, B. et al. "Fast Ion Mobility Spectrometry and High Resolution TOF MS" ASMS Conference Poster (2014).
Verenchicov., A. N. "Parallel MS-MS Analysis in a Time-Flight Tandem. Problem Statement, Method, and Instrucmental Schemes" Institute for Analytical Instrucmentation RAS, Saint-Petersburg, (2004).
Yavor, M. I. "Planar Multireflection Time-Of-Flight Mass Analyser with Unlimited Mass Range" Institute for Analytical Instrucmentation RAS, Saint-Petersburg, (2004).
Khasin, Y. I. et al. "Initial Experimenatl Studies of a Planar Multireflection Time-Of-Flight Mass Spectrometer" Institute for Analytical Instrucmentation RAS, Saint-Petersburg, (2004).
Verenchicov., A. N. et al. "Stability of Ion Motion in Periodic Electrostatic Fields" Institute for Analytical Instrucmentation RAS, Saint-Petersburg, (2004).
Verenchicov., A. N. "The Concept of Mutireflecting Mass Spectrometer for Continuous Ion Sources" Institute for Analytical Instrucmentation RAS, Saint-Petersburg, (2006).
Verenchicov., A. N., et al. "Accurate Mass Measurements for Inerpreting Spectra of atmospheric Pressure Ionization" Institute for Analytical Instrucmentation RAS, Saint-Petersburg, (2006).
Kozlov, B. N. et al., "Experimental Studies of Space Charge Effects in Multireflecting Time-Of-Flight Mass Spectrometes" Institute for Analytical Instrucmentation RAS, Saint-Petersburg, (2006).
Kozlov, B. N. et al., "Multireflecting Time-Of-Flight Mass Spectrometer With an Ion Trap Source" Institute for Analytical Instrucmentation RAS, Saint-Petersburg, (2006).
Hasin, Y. I., et al., "Planar Time-Of-Flight Multireflecting Mass Spectrometer with an Orthogonal Ion Injection Out of Continuous Ion Sources" Institute for Analytical Instrucmentation RAS, Saint-Petersburg, (2006).
Lutvinsky Y. I. et al., "Estimation of Capacity of High Resolution Mass Spectra for Analysis of Complex Mixtures" Institute for Analytical Instrucmentation RAS, Saint-Petersburg, (2006).
Verenchicov., A. N. et al. "Accurate Mass Measurements for Interpreting Spectra of Atmospheric Pressure Ionization" Institute for Analytical Instrucmentation RAS, Saint-Petersburg, (2006).
Verenchicov., A. N. et al. "Multiplexing in Multi-Reflecting TOF MS" Journal of Applied Solution Chemistry and Modeling, 6:1-22 (2017).
Supplementary Partial EP Search Report for EP Application No. 16869126.9, dated Jun. 13, 2019.

* cited by examiner

IMAGING MASS SPECTROMETER

CROSS-REFERENCE TO RELATED APPLICATIONS

This application is a national phase filing claiming the benefit of and priority to International Patent Application No. PCT/US2016/062174, filed on Nov. 16, 2016, which claims priority from and the benefit of United Kingdom patent application No. 1520130.4 filed on Nov. 16, 2015. The entire contents of these applications are incorporated herein by reference.

FIELD OF THE INVENTION

This invention relates to the field of mass-spectrometry, and in particular to a multi-reflecting time-of-flight mass spectrometer with a folded ion path.

BACKGROUND

It is known to surface image or analyze multiple sample spots by scanning a laser beam over a sample plate such that ions are introduced at the optical axis of a mass spectrometer. For example, MALDI or DE-MALDI analysis has been conducted using a multi-spot sample plate.

It is also known to image a sample with a Time of Flight (TOF) mass spectrometer comprising electric sectors, such as in U.S. Pat. No. 5,128,543. Such analyzers typically image a small sample area by illuminating the sample with a homogeneous ion beam or laser, and then using toroidal or spherical electric sectors to transfer the resulting sample ions to a position sensitive detector in a manner that provides point to point imaging. These analyzers provide first order time-per-energy focusing and posses imaging properties, i.e. provide point to point transfer with first order tolerance to angular and energy spreads. Thus, two dimensional imaging and mass measurement may be performed simultaneously. Such analyzers may have a spatial resolution of approximately 1 micron for a 1 mm field of view, while providing a mass resolution of approximately 1000.

However, such electric sector based TOF instruments have low order time of flight and spatial focusing aberrations, and have multiple second order aberrations that are not compensated for. For example, due to third-order spatial and second-order TOF chromatic aberrations, sector-based imaging TOF mass spectrometers can only be applied to microscopy analysis of surfaces in case analyzed ions have a small energy spread, otherwise mass resolution is destroyed by large chromatic TOF aberrations. Also, multi-sector TOF mass spectrometers are not suitable for the analysis of a large field of view due to their large spatial third-order aberrations, mainly induced by fringing-field effects in the electrostatic sector fields. As such, these systems do not provide high mass resolution and are poorly suited to imaging relatively large fields of view, e.g. above 1 mm.

It is therefore desired to provide an improved time of flight mass spectrometer and an improved method of time of flight mass spectrometry.

SUMMARY

The present invention provides a time-of-flight mass spectrometer comprising:

an ion source array for supplying or generating ions at an array of positions;

a position sensitive ion detector; and ion optics arranged and configured to guide ions from the ion source array to the position sensitive detector so as to map ions from the array of positions on the ion source array to an array of positions on the position sensitive detector;

wherein the ion optics includes at least one gridless ion mirror for reflecting ions.

The ion optics may map ions from the array of positions on the ion source array to a respective, corresponding array of positions on the position sensitive detector.

The inventors have realized that the use of a gridless ion mirror (e.g. reflectron) for ion mapping in time-of-flight mass spectrometers substantially improves the mass resolution and spatial resolution of the instrument, e.g. as compared to electric sector based instruments. For example, as discussed above in the Background section, sector-based time-of-flight instruments such as U.S. Pat. No. 5,128,543 have low order time of flight and spatial focusing aberrations, and have multiple second order aberrations that are not compensated for. This restricts the use of such instruments. The present invention provides an improved instrument by using a gridless ion mirror (e.g. reflectron) in the ion optics that maps the ions onto the detector.

It will be appreciated by the skilled person that the arrangement of one or more electric sectors that guide ions along a non-linear path does not constitute an ion mirror. In contrast, an ion mirror is a device that is well-known in the art and that receives ions (at a front of the device) with a primary component of velocity along a first direction, decelerates those ions until they have no velocity in the first direction (at the back of the device), and then reflects the ions back such that they are accelerated in a second direction that is opposite to the first direction and back out of the ion mirror. Ion mirrors therefore focus ions according to their time of flight along the first and second directions. The ions may therefore exit the ion mirror with a velocity in the second direction that is of substantially equal magnitude and opposite direction to that with which the enter the ion mirror in the first direction. The ions may have velocity components in dimensions orthogonal to the first direction, although these components are significantly smaller than the primary velocity component in the first direction.

For the avoidance of doubt, a gridless ion mirror is an ion mirror in which the ion flight region is free from grids or meshes, such as electrode grids or electrode meshes used to maintain electric fields.

US 2014/0361162 describes an imaging mass spectrometer for mapping ions from an array of spots on a sample plate to an array of positions on a detector. An ion mirror is provided that reflects ions from the target plate to the detector. US 2014/0183354 describes a mass microscope comprising a position sensitive detector and an ion mirror. However, these documents neither disclose that the ion mirror is a gridless ion mirror nor recognise that such a gridless ion mirror can be used in order to compensate for various aberrations and allow the instrument to have a relatively high mass and spatial resolutions. Rather, it has been recognised that the electrode meshes in the gridded ion mirrors that are conventionally used would cause ion scattering and degrade the spatial resolution at the detector.

In contrast to the prior art, embodiments of the present invention are configured such that the ions are reflected multiple times by a gridless ion mirror, or multiple times between gridless ion mirrors, as they pass from the ion source array to the position sensitive detector. As the ions are reflected multiple times in the ion mirror(s), the instrument is able to compensate for various aberrations and have relatively high mass and spatial resolutions.

The spectrometer may be used to map ions from multiple different samples to separate spots at the detector, or may be used to map multiple spots from different areas of a single sample to different areas on the detector. Conventional spectrometers, such as sector based TOF mass spectrometers, are poorly suited to both of these modes due to large spatial geometric and chromatic aberrations when a large field of view is used as well as large chromatic TOF aberrations created by energy spreads in most of the ionization methods.

The position sensitive detector may comprise an array of separate detection regions, wherein ions received at different detection regions may be determined or assigned as having originated from different positions in the array of positions at the ion source array. Alternatively, or additionally, ions received at any given position in the array of positions at the detector may be determined or assigned as having originated from the corresponding position in the array of positions at the ion source array.

The spectrometer may comprise an ion accelerator for pulsing ions from the ion source array, downstream towards the detector, and the spectrometer may be configured to determine the flight times of the ions from the ion accelerator to the detector. The spectrometer may therefore be configured to determine the mass to charge ratios of the ions from the flight times.

The ion accelerator may be an orthogonal accelerator for accelerating the ions orthogonally. Additionally, or alternatively, the ion accelerator may be a gridless ion accelerator. For the avoidance of doubt, a gridless ion accelerator is an ion accelerator having an ion acceleration or flight region that is free from grids or meshes, such as electrode grids or meshes used to maintain electric fields.

Ions detected at different locations of said array of locations at the detector may be recorded or summed separately.

Said ion optics may include at least two ion mirrors for reflecting ions.

Said at least two ion mirrors may be gridless ion mirrors.

Said ion optics, including the at least two ion mirrors, may be arranged and configured such that the ions are reflected by each of the mirrors and between the mirrors a plurality of times before reaching the detector.

Said two ion mirrors may be spaced apart from each other in a first dimension (X-dimension) and each elongated in a second dimension (Z-dimension) or along a longitudinal axis that is orthogonal to the first dimension. The spectrometer may be configured such that the ions drift in the second dimension (Z-dimension) or along the longitudinal axis towards the detector as they are reflected between the mirrors.

The ion mirrors may be planar ion mirrors and/or the longitudinal axis may be straight.

Alternatively, the longitudinal axis may be curved.

The spectrometer may comprise an ion introduction mechanism for introducing packets of ions into the space between the mirrors such that they travel along a trajectory that is arranged at an angle to the first and second dimensions such that the ions repeatedly oscillate in the first dimension (X-dimension) between the mirrors as they drift through said space in the second dimension (Z-dimension).

The ion optics may include at least one ion mirror for reflecting ions and at least one electrostatic or magnetic sector for receiving ions and guiding the ions into the at least one ion mirror; wherein the at least one ion mirror and at least one sector may be configured such that the ions are transmitted from the at least one sector into each mirror a plurality of times such that the ions are reflected by said each ion mirror a plurality of times.

At least two ion mirrors and at least one sector may be provided, which are configured such that the at least one sector repeatedly guides ions between the ion mirrors such that the ions are reflected by each ion mirror a plurality of times.

A plurality of electrostatic or magnetic sectors may be provided for repeatedly receiving the ions from an ion mirror and repeatedly guiding ions back into the ion mirror such that the ions are reflected by the ion mirror a plurality of times.

Each ion mirror may be spaced apart from each sector in a first dimension (X-dimension) such that the ions travel in the first dimension between the mirror(s) and sector(s), and each ion mirror or sector may be configured to guide or allow ions to drift towards the detector along an axis that is orthogonal to the first dimension.

The axis may be linear or may be curved.

The ion guiding region of the at least one sector may be substantially hemispherical or a portion of a hemisphere; or wherein the ion guiding region of said at least one sector is substantially a half-cylinder.

Such sectors are useful for preserving the 1D or 2D ion mapping. For example, the half-cylindrical sectors may be used for 1D mapping, or the hemispherical sectors may be used for 2D mapping.

Said at least one ion mirror, or one or more of said at least two ion mirrors, may be planar ion mirrors.

The spectrometer may be configured such that ions are reflected in each ion mirror, or in all of the ion mirrors in the spectrometer, for a number of ion reflections selected from the group consisting of: ≥2; ≥4; ≥6; ≥8; ≥10; ≥12; ≥14; ≥16; ≥18; ≥20; ≥22; ≥24; ≥26; ≥28; ≥30; ≥32; ≥34; ≥36; ≥38; and ≥40.

The spectrometer may be configured such that ions travel a distance of d cm in at least one of the ion mirrors, between two of the ion mirrors, or between an ion mirror and a sector; wherein d is selected from the group consisting of: 20; 25; 30; 35; 40; 45; 50; 55; 60; 65; 70; 75; 80; 85; 90; 95; 100; 110; 120; and 140.

It has been discovered that the use of relatively large distances d reduces high order time-of-flight and spatial aberrations.

All of the ion mirrors in the spectrometer may be gridless ion mirrors.

The ion optics may be configured to reflect ions multiple times in a first dimension (X-dimension) as the ions drift in a second, orthogonal dimension (Z-dimension); and the ion optics may comprise one or more ion optical lens through which the ions pass, in use, for focusing ions in a plane defined by the first and second dimensions (X-Z plane).

Whilst the ions are reflected multiple times in the first dimension (X-dimension) they only pass through gridless ion optics.

Each lens may be formed from multiple pairs of opposing electrodes. Optionally, each electrode is a planar electrode.

The array of positions at the ion source array and/or the array of positions at the detector may be a one-dimensional array, or a two-dimensional array. The array of positions at the ion source array may be a one-dimensional array, and the array of positions at the detector may be a two-dimensional array. Alternatively, the array of positions at the ion source array may be a two-dimensional array, and the array of positions at the detector may be a one-dimensional array. Ion optics may be arranged between the arrays to covert the array from a one-dimensional array to a two dimensional array, or vice versa.

Each position in the array of positions on the ion source array may be spatially separated from all of the other positions in the array of positions at the ion source array, and/or each position in the array of positions on the detector may be spatially separated from all of the other positions in the array of positions at the detector. The ion source array may therefore be configured to supply or generate ions at an array of spatially separated positions.

Alternatively, each position in the array of positions on the ion source array may not be spatially separated from adjacent positions in the array of positions at the ion source array, and/or each position in the array of positions on the detector may not be spatially separated from adjacent positions in the array of positions at the detector.

The ion source array may be configured to supply or generate multiple ion beams or packets of ions at said array of positions from the same analytical sample source, or from different analytical sample sources.

The ion source array may comprise a target plate and an ionizing device for generating at least one primary ion beam, at least one laser beam, or at least one electron beam for ionizing one or more analytical samples located on the target plate at said array of positions.

The ionizing device may be configured to direct one of the primary ion beams, laser beams or electron beams at each position in said array of positions at the ion source array.

Said at least one primary ion beam, at least one laser beam or at least one electron beam may be continuously scanned or stepped between different positions of said array of positions on the target plate.

Each position of the different positions of said array of positions on the target plate comprises an area, and said at least one primary ion beam, at least one laser beam or at least one electron beam may be continuously scanned or stepped across different portions of said area. This is useful when ionizing unstable samples, since it enables the ionizing beam intensity at any given portion at any given time to be kept relatively low whilst continuing to ionize the sample at each position.

The target plate may comprise a plurality of sample wells arranged at said array of positions on the ion source array.

The ion source array may comprise a single ion source for generating ions and an ion divider for dividing or guiding the ions generated by the ion source to the array of positions on the ion source array.

The ion source array may comprise an ion source and a magnetic sector for separating ions of different mass to charge ratios in a plane substantially perpendicular to a portion of the flight paths of the ions through the magnetic sector so as to form an array of different ion beams having different mass to charge ratios. An electric sector may be provided between the ion source and the magnetic sector and may operate as an energy filter that filters ions according to their energy prior to entry into the magnetic sector.

According to the instruments and methods described herein, the ions may be generated or supplied at said ion source array in a pulsed manner or in a continuous manner.

The ion source array may comprise atmospheric pressure or ambient pressure ion sources. Additionally, or alternatively, the ion source array may comprise sub-atmospheric pressure or sub-ambient pressure ion sources.

The ion source array may comprise at least one type of ion source selected from the list of: ESI, APCI, APPI, CGD, DESI, DART, MALDI, electron impact, chemical ionization, and glow discharge ion sources.

The spectrometer may be configured to simultaneously map ions from the array of different positions on the ion source array to the array of different positions on the position sensitive detector. As such, the instrument provides a much higher throughput than conventional instruments.

Said at least one ion mirror is configured to receive an array of ion packets from the ion source array. The at least one ion mirror reflects the ions in a first dimension (X-dimension), wherein the array of ion packets may be distributed in a plane substantially perpendicular to the first dimension.

The spectrometer may be configured to map ions to the detector from the array of positions at the ion source array, wherein the array of positions may extend ≥x mm in a first direction, wherein x is selected from the group consisting of: 1; 2; 3; 4; 5; 6; 7; 8; 9; and 10.

Optionally, the spectrometer may be configured to map ions to the detector from an array of positions at the ion source array wherein the array of positions may extend y mm in a second direction orthogonal to the first direction, wherein y may be selected from the group consisting of: 1; 2; 3; 4; 5; 6; 7; 8; 9; and 10.

The array of positions at the ion source array may be in the form of a matrix having ≥n elements or positions in a first direction and ≥m elements or positions in a second orthogonal direction, wherein n may be selected from the group consisting of: 1; 2; 3; 4; 5; 6; 7; 8; 9; 10; 15; 20; 25; 30; 35; 40; 45; 50; 55; 60; 65; 70; 75; 80; 85; 90; 95; 100; 120; 140; 160; 180; and 200, and/or wherein m may be selected from the group consisting of: 1; 2; 3; 4; 5; 6; 7; 8; 9; 10; 15; 20; 25; 30; 35; 40; 45; 50; 55; 60; 65; 70; 75; 80; 85; 90; 95; 100; 120; 140; 160; 180; and 200.

The matrix may have a size in a first dimension selected from the group consisting of: ≥0.1 mm; ≥0.2 mm; ≥0.3 mm; ≥0.4 mm; ≥0.5 mm; ≥0.6 mm; ≥0.7 mm; ≥0.8 mm; ≥0.9 mm; ≥1 mm; ≥2.5 mm; ≥5 mm; ≥10 mm; ≥15 mm; ≥20 mm; ≥25 mm; ≥30 mm; ≥35 mm; ≥40 mm; and ≥50 mm; and optionally the matrix may have a size in a second dimension orthogonal to the first dimension that is selected from the group consisting of: ≥0.1 mm; ≥0.2 mm; ≥0.3 mm; ≥0.4 mm; ≥0.5 mm; ≥0.6 mm; ≥0.7 mm; ≥0.8 mm; ≥0.9 mm; ≥1 mm; ≥2.5 mm; ≥5 mm; ≥10 mm; ≥15 mm; ≥20 mm; ≥25 mm; ≥30 mm; ≥35 mm; ≥40 mm; and ≥50 mm.

An array of ion beams or ion packets may be formed at the ion source array, and each ion beam or ion packet may have a diameter of at least 0.25 mm, at least 0.5 mm, at least 0.75 mm, at least 1 mm, at least 1.25 mm, or at least 1.5 mm.

An array of ion beams or ion packets is received at the detector, wherein each ion beam or ion packet may have a diameter of at least 0.25 mm, at least 0.5 mm, at least 0.75 mm, at least 1 mm, at least 1.25 mm, or at least 1.5 mm.

The diameter of each ion beam or ion packet may be larger at the detector than at the ion source array.

An array of ion beams or ion packets is formed at the ion source array, wherein the spatial pitch between the ion beams or ion packets may be selected from the list comprising: ≥0.1 mm; ≥0.2 mm; ≥0.3 mm; ≥0.4 mm; ≥0.5 mm; ≥0.6 mm; ≥0.7 mm; ≥0.8 mm; ≥0.9 mm; ≥1 mm; ≥2.5 mm; ≥5 mm; and ≥10 mm.

The spectrometer may comprise an electrostatic and/or magnetic sector for guiding ions from the ion source array downstream towards the at least one ion mirror; and/or an electrostatic and/or magnetic sector for guiding ions from the at least one ion mirror downstream towards the detector. Using sector interfaces allows a relatively large ion source array and detector to be arranged outside of the TOF region, whilst introducing ions into and extracting ions from the TOF region. Also, sectors are capable of removing excessive energy spread of the ions so as to optimize spatial and mass resolution with only moderate ion losses. Sectors may also be used as part of telescopic arrangements for optimal adoption of spatial scales between the ion source, the TOF analyzer and the detector. The relatively low ion optical quality of sectors is not problematic, since ions spend only a relatively small portion of flight time in these sectors.

The sector(s) for guiding ions from the ion source array towards the ion mirror, and/or the electrostatic and/or magnetic sector for guiding ions from the ion mirror towards the detector, may be substantially hemispherical or a portion of a hemisphere; or may have an ion guiding region that is substantially a half-cylinder. Such sectors are useful for 1D or 2D ion mapping. For example, the half-cylindrical sectors may be used for 1D mapping, or the hemispherical sectors may be used for 2D mapping.

The spectrometer may comprise an array of quadrupoles, ion guides or ion traps configured so that ions generated or supplied at different positions, in said array of positions on the ion source array, are transmitted into different quadrupoles, ion guides or ion traps in said array of quadrupoles, ion guides or ion traps.

The spectrometer may be configured to apply electrical potentials at the exits of the quadrupoles, ion guides or ion traps so as to trap and release ions from the quadrupoles, ion guides or ion traps in a pulsed manner downstream towards the detector.

The spectrometer may further comprise a telescopic converter or lens arranged downstream of the ion source array, wherein the telescopic converter or lens increases or decreases the width in a first dimension of the array of ion beams or ion packets supplied or generated at the ion source array; and/or wherein the telescopic converter or lens increases or decreases the width in a second, different dimension of the array of ion beams or ion packets supplied or generated at the ion source array. The telescopic converter or lens may be used to reduce the angular spread of the ion beams or ion packets. Alternatively, or additionally, the telescopic converter or lens may be used to interface the spatial scales of the ion source array, analyzer and detector.

The ion optics may comprise an array of micro-lenses arranged and configured for focusing ions from the array of positions at the ion source array, optionally wherein different lenses of the micro-lens array focus ions generated or supplied at different positions of the array of positions at the ion source array.

The spectrometer may comprise an orthogonal accelerator for orthogonally accelerating ions into one of said ion mirrors, optionally wherein the orthogonal accelerator is a gridless orthogonal accelerator.

If the spectrometer comprises the telescopic converter or lens, the orthogonal accelerator may be downstream of the telescopic converter or lens such that relatively narrow ion beams are provided to the orthogonal accelerator, thus preserving the separation of the ion beams from each other.

The ion source array may comprise an ion source and an ion guide configured to receive ions from the ion source and to guide ions received from the ion source at different times to different positions in said array of positions at the ion source.

An ion separator may be provided between the ion source and ion guide for separating ions according to a physicochemical property such that ions having different values of said physicochemical property are guided to different positions in said array of positions at the ion source. The physicochemical property may be, for example, ion mobility or mass to charge ratio.

The spectrometer may comprise a fragmentation or reaction device downstream of the ion source array for fragmenting the ions to produce fragment ions or for reacting the ions with reagent ions or molecules so as to form product ions; and wherein said detector or another detector is provided to detect the fragment or product ions.

The spectrometer may be configured to repeatedly switch the fragmentation or reaction device between a first fragmentation or reaction mode that provides a high level of fragmentation or reaction and a second fragmentation or reaction mode that provides a lower level or no fragmentation or reaction, during a single experimental run. Alternatively, or additionally, the spectrometer may be configured to repeatedly switch between a first mode in which ions are fragmented or reacted in the fragmentation or reaction device and a second mode in which ions bypass the fragmentation or reaction device, during a single experimental run.

The spectrometer may be configured to correlate precursor ion data detected in the second mode with fragment or product ion data that is detected in the first mode.

It is contemplated, though less desirable, that said at least one ion mirror for reflecting ions need not be gridless (e.g. in less desirable instruments the at least one mirror could be gridded).

It is contemplated, though less desirable, that said ion optics does not include said at least one gridless ion mirror for reflecting ions. For example, the ion optics may include at least one electric sector configured to guide ions from the ion source array to the detector so as to map ions from the array of positions on the ion source array to the array of positions on the detector.

It is contemplated, though less desirable, that said ion detector need not be a position sensitive detector.

It is contemplated, though less desirable, that the mass spectrometer may not be a time-of-flight mass spectrometer.

The present invention also provides a method of time of flight mass spectrometry comprising operating the spectrometer described herein.

Accordingly, from the present invention provides a method of time-of-flight mass spectrometry comprising:

supplying or generating ions at an array of positions on an ion source array;

providing a position sensitive ion detector; and using ion optics to guide ions from the ion source array to the position sensitive detector so as to map ions from the array of positions on the ion source array to an array of positions on the position sensitive detector;

wherein the ion optics includes at least one gridless ion mirror that reflects the ions.

The ion optics may map ions from the array of positions on the ion source array to a respective, corresponding array of positions on the position sensitive detector.

It is contemplated, though less desirable, that said at least one ion mirror that reflects ions need not be gridless.

It is contemplated, though less desirable, that said ion optics does not include said at least one gridless ion mirror that reflects ions. For example, the ion optics may include at least one electric sector that maps ions from the array of positions on the ion source array to the array of positions on the detector.

It is contemplated, though less desirable, that said ion detector need not be a position sensitive detector.

It is contemplated, though less desirable, that the method of mass spectrometry need not be a method of time-of-flight mass spectrometry.

The spectrometer may comprise an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; (xx) a Glow Discharge ("GD") ion source; (xxi) an Impactor ion source; (xxii) a Direct Analysis in Real Time ("DART") ion source; (xxiii) a Laserspray Ionisation ("LSI") ion source; (xxiv) a Sonicspray Ionisation ("SSI") ion source; (xxv) a Matrix Assisted Inlet Ionisation ("MAII") ion source; (xxvi) a Solvent Assisted Inlet Ionisation ("SAII") ion source; (xxvii) a Desorption Electrospray Ionisation ("DESI") ion source; and (xxviii) a Laser Ablation Electrospray Ionisation ("LAESI") ion source.

The spectrometer may comprise one or more continuous or pulsed ion sources.

The spectrometer may comprise one or more ion guides.

The spectrometer may comprise one or more ion mobility separation devices and/or one or more Field Asymmetric Ion Mobility Spectrometer devices.

The spectrometer may comprise one or more ion traps or one or more ion trapping regions.

The spectrometer may comprise one or more collision, fragmentation or reaction cells selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device.

The spectrometer may comprise a mass analyser selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic mass analyser arranged to generate an electrostatic field having a quadro-logarithmic potential distribution; (x) a Fourier Transform electrostatic mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser.

The spectrometer may comprise one or more energy analysers or electrostatic energy analysers.

The spectrometer may comprise one or more ion detectors.

The spectrometer may comprise one or more mass filters selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wien filter.

The spectrometer may comprise a device or ion gate for pulsing ions; and/or a device for converting a substantially continuous ion beam into a pulsed ion beam.

The spectrometer may comprise a C-trap and a mass analyser comprising an outer barrel-like electrode and a coaxial inner spindle-like electrode that form an electrostatic field with a quadro-logarithmic potential distribution, wherein in a first mode of operation ions are transmitted to the C-trap and are then injected into the mass analyser and wherein in a second mode of operation ions are transmitted to the C-trap and then to a collision cell or Electron Transfer Dissociation device wherein at least some ions are fragmented into fragment ions, and wherein the fragment ions are then transmitted to the C-trap before being injected into the mass analyser.

The spectrometer may comprise a stacked ring ion guide comprising a plurality of electrodes each having an aperture through which ions are transmitted in use and wherein the spacing of the electrodes increases along the length of the ion path, and wherein the apertures in the electrodes in an upstream section of the ion guide have a first diameter and wherein the apertures in the electrodes in a downstream section of the ion guide have a second diameter which is smaller than the first diameter, and wherein opposite phases of an AC or RF voltage are applied, in use, to successive electrodes.

The spectrometer may comprise a device arranged and adapted to supply an AC or RF voltage to the electrodes. The AC or RF voltage optionally has an amplitude selected from the group consisting of: (i) about <50 V peak to peak; (ii) about 50-100 V peak to peak; (iii) about 100-150 V peak to peak; (iv) about 150-200 V peak to peak; (v) about 200-250

V peak to peak; (vi) about 250-300 V peak to peak; (vii) about 300-350 V peak to peak; (viii) about 350-400 V peak to peak; (ix) about 400-450 V peak to peak; (x) about 450-500 V peak to peak; and (xi) >about 500 V peak to peak.

The AC or RF voltage may have a frequency selected from the group consisting of: (i) <about 100 kHz; (ii) about 100-200 kHz; (iii) about 200-300 kHz; (iv) about 300-400 kHz; (v) about 400-500 kHz; (vi) about 0.5-1.0 MHz; (vii) about 1.0-1.5 MHz; (viii) about 1.5-2.0 MHz; (ix) about 2.0-2.5 MHz; (x) about 2.5-3.0 MHz; (xi) about 3.0-3.5 MHz; (xii) about 3.5-4.0 MHz; (xiii) about 4.0-4.5 MHz; (xiv) about 4.5-5.0 MHz; (xv) about 5.0-5.5 MHz; (xvi) about 5.5-6.0 MHz; (xvii) about 6.0-6.5 MHz; (xviii) about 6.5-7.0 MHz; (xix) about 7.0-7.5 MHz; (xx) about 7.5-8.0 MHz; (xxi) about 8.0-8.5 MHz; (xxii) about 8.5-9.0 MHz; (xxiii) about 9.0-9.5 MHz; (xxiv) about 9.5-10.0 MHz; and (xxv) >about 10.0 MHz.

The spectrometer may comprise a chromatography or other separation device upstream of an ion source. The chromatography separation device may comprise a liquid chromatography or gas chromatography device. Alternatively, the separation device may comprise: (i) a Capillary Electrophoresis ("CE") separation device; (ii) a Capillary Electrochromatography ("CEC") separation device; (iii) a substantially rigid ceramic-based multilayer microfluidic substrate ("ceramic tile") separation device; or (iv) a supercritical fluid chromatography separation device.

The ion guide may be maintained at a pressure selected from the group consisting of: (i) <about 0.0001 mbar; (ii) about 0.0001-0.001 mbar; (iii) about 0.001-0.01 mbar; (iv) about 0.01-0.1 mbar; (v) about 0.1-1 mbar; (vi) about 1-10 mbar; (vii) about 10-100 mbar; (viii) about 100-1000 mbar; and (ix) >about 1000 mbar.

Analyte ions may be subjected to Electron Transfer Dissociation ("ETD") fragmentation in an Electron Transfer Dissociation fragmentation device. Analyte ions may be caused to interact with ETD reagent ions within an ion guide or fragmentation device.

Optionally, in order to effect Electron Transfer Dissociation either: (a) analyte ions are fragmented or are induced to dissociate and form product or fragment ions upon interacting with reagent ions; and/or (b) electrons are transferred from one or more reagent anions or negatively charged ions to one or more multiply charged analyte cations or positively charged ions whereupon at least some of the multiply charged analyte cations or positively charged ions are induced to dissociate and form product or fragment ions; and/or (c) analyte ions are fragmented or are induced to dissociate and form product or fragment ions upon interacting with neutral reagent gas molecules or atoms or a non-ionic reagent gas; and/or (d) electrons are transferred from one or more neutral, non-ionic or uncharged basic gases or vapours to one or more multiply charged analyte cations or positively charged ions whereupon at least some of the multiply charged analyte cations or positively charged ions are induced to dissociate and form product or fragment ions; and/or (e) electrons are transferred from one or more neutral, non-ionic or uncharged superbase reagent gases or vapours to one or more multiply charged analyte cations or positively charged ions whereupon at least some of the multiply charge analyte cations or positively charged ions are induced to dissociate and form product or fragment ions; and/or (f) electrons are transferred from one or more neutral, non-ionic or uncharged alkali metal gases or vapours to one or more multiply charged analyte cations or positively charged ions whereupon at least some of the multiply charged analyte cations or positively charged ions are induced to dissociate and form product or fragment ions; and/or (g) electrons are transferred from one or more neutral, non-ionic or uncharged gases, vapours or atoms to one or more multiply charged analyte cations or positively charged ions whereupon at least some of the multiply charged analyte cations or positively charged ions are induced to dissociate and form product or fragment ions, wherein the one or more neutral, non-ionic or uncharged gases, vapours or atoms are selected from the group consisting of: (i) sodium vapour or atoms; (ii) lithium vapour or atoms; (iii) potassium vapour or atoms; (iv) rubidium vapour or atoms; (v) caesium vapour or atoms; (vi) francium vapour or atoms; (vii) $C_{60}$ vapour or atoms; and (viii) magnesium vapour or atoms.

The multiply charged analyte cations or positively charged ions may comprise peptides, polypeptides, proteins or biomolecules.

Optionally, in order to effect Electron Transfer Dissociation: (a) the reagent anions or negatively charged ions are derived from a polyaromatic hydrocarbon or a substituted polyaromatic hydrocarbon; and/or (b) the reagent anions or negatively charged ions are derived from the group consisting of: (i) anthracene; (ii) 9,10 diphenyl-anthracene; (iii) naphthalene; (iv) fluorine; (v) phenanthrene; (vi) pyrene; (vii) fluoranthene; (viii) chrysene; (ix) triphenylene; (x) perylene; (xi) acridine; (xii) 2,2' dipyridyl; (xiii) 2,2' biquinoline; (xiv) 9-anthracenecarbonitrile; (xv) dibenzothiophene; (xvi) 1,10'-phenanthroline; (xvii) 9' anthracenecarbonitrile; and (xviii) anthraquinone; and/or (c) the reagent ions or negatively charged ions comprise azobenzene anions or azobenzene radical anions.

The process of Electron Transfer Dissociation fragmentation may comprise interacting analyte ions with reagent ions, wherein the reagent ions comprise dicyanobenzene, 4-nitrotoluene or azulene.

A chromatography detector may be provided, wherein the chromatography detector comprises either:

a destructive chromatography detector optionally selected from the group consisting of (i) a Flame Ionization Detector (FID); (ii) an aerosol-based detector or Nano Quantity Analyte Detector (NQAD); (iii) a Flame Photometric Detector (FPD); (iv) an Atomic-Emission Detector (AED); (v) a Nitrogen Phosphorus Detector (NPD); and (vi) an Evaporative Light Scattering Detector (ELSD); or a non-destructive chromatography detector optionally selected from the group consisting of: (i) a fixed or variable wavelength UV detector; (ii) a Thermal Conductivity Detector (TCD); (iii) a fluorescence detector; (iv) an Electron Capture Detector (ECD); (v) a conductivity monitor; (vi) a Photoionization Detector (PID); (vii) a Refractive Index Detector (RID); (viii) a radio flow detector; and (ix) a chiral detector.

The spectrometer may be operated in various modes of operation including a mass spectrometry ("MS") mode of operation; a tandem mass spectrometry ("MS/MS") mode of operation; a mode of operation in which parent or precursor ions are alternatively fragmented or reacted so as to produce fragment or product ions, and not fragmented or reacted or fragmented or reacted to a lesser degree; a Multiple Reaction Monitoring ("MRM") mode of operation; a Data Dependent Analysis ("DDA") mode of operation; a Data Independent Analysis ("DIA") mode of operation a Quantification mode of operation or an Ion Mobility Spectrometry ("IMS") mode of operation.

BRIEF DESCRIPTION OF THE DRAWINGS

Various embodiments will now be described, by way of example only, and with reference to the accompanying drawings in which.

DETAILED DESCRIPTION

Figure 1:
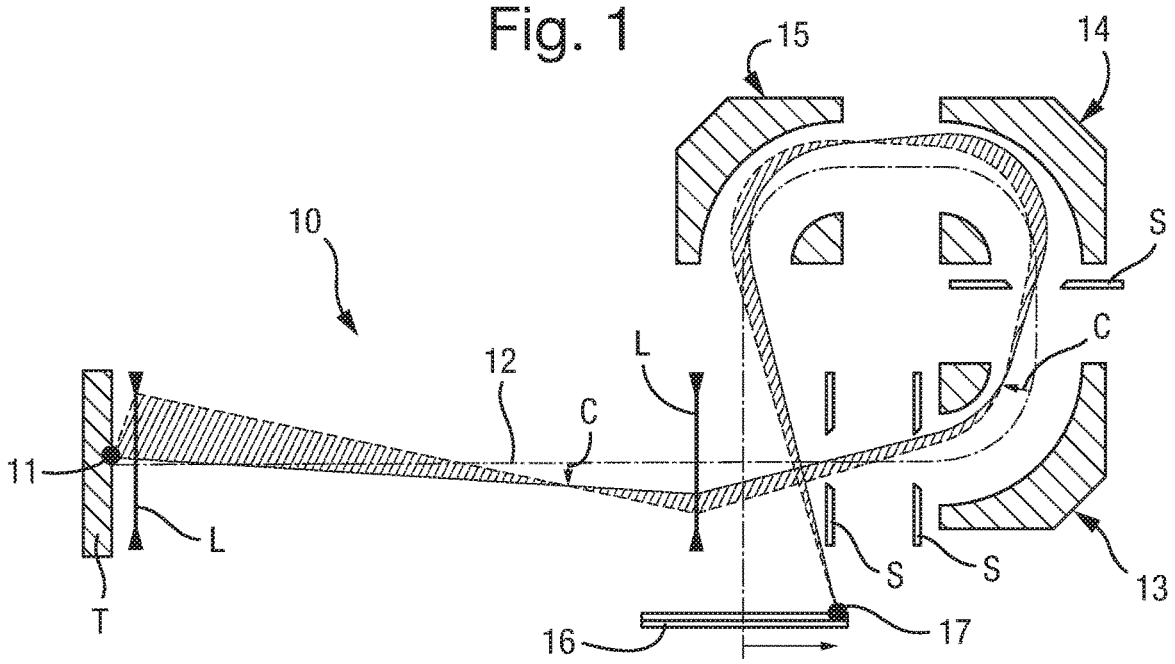
FIG. 1 shows a known mass microscope.

In order to assist the understanding of the present invention, a prior art instrument will now be described with reference to FIG. 1. FIG. 1 shows a mass microscope 10 as described in U.S. Pat. No. 5,128,543. The mass microscope comprises a target T that is illuminated by a laser pulse, a position sensitive Time of Flight (TOF) detector 16, and an analyzer that is formed by lenses L, slits S and three 90-degree spherical electrostatic sectors 13, 14 and 15 that are separated by field-free regions. Secondary ion packets originate from point 11 on the target T with an angular spread. The ions travel within the dashed curved area of trajectories and are focused onto the position sensitive detector 16 at point 17. A multiplicity of emitting spots form a magnified two dimensional image on the detector 16, while the TOF detector also measures the ion masses by their flight times. In an all-mass mode, a dual microchannel plate (MCP) detector with resistive anode is used to determine the X and Y positions of rare striking ions. Alternatively, imaging may be performed on a phosphor screen downstream of an MCP by using higher ion fluxes and selecting ions of a single mass with a time gate. The typical size of the image field is 200 microns, the spatial resolution is 3 μm and the magnification from the target to the detector is x60. A moderate mass resolution of about 3,000 is achieved, although this is limited by the short flight path available in the sectors 13-15.

More recent multi-sector systems provide higher mass resolutions, although at a compromised spatial resolution of 100 μm for DE-MALDI sources. A small viewing field, and moderate spatial and mass resolutions are characteristic for electric sector TOF instruments since they have a limited flight path length and compensate only for first order spatial and time-of-flight aberrations.

Figure 2A:
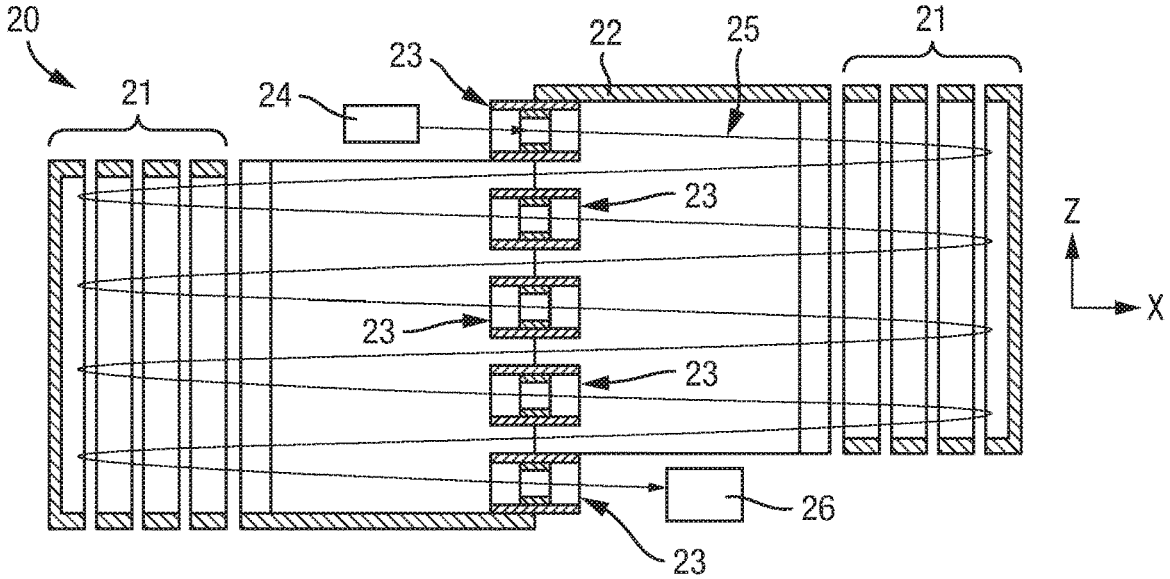
FIGS. 2A and 2B illustrate a known multi-reflecting mass spectrometer.
Figure 2B:
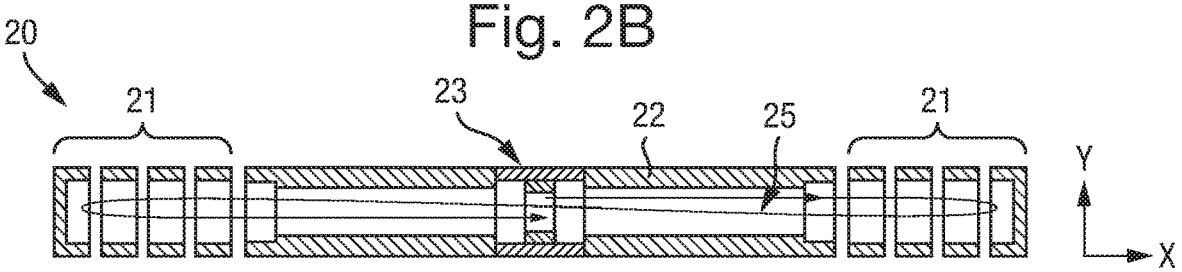

FIGS. 2A and 2B illustrate a prior art instrument according to WO 2005/001878. The instrument is a multi-reflecting mass spectrometer 20 comprising a pair of planar mirrors 21, a drift space 22, a periodic lens array 23, a pulsed ion source 24 and a detector 26. The planar ion mirrors 21 are formed by metal frames and are extended in a direction along the ion drift direction Z. The ions pulsed into the drift space 22 between the ion mirrors 21 such that they perform multiple reflections between the ion mirrors 21 as they drift in the z-direction to the detector 26. The multiple mirror reflections extend the flight path of the ions, which improves mass resolution. The periodic lens 23 confine the ion packets along the main zig-zag trajectory 25.

FIG. 2B shows a view in the X-Y plane. Due to lower order lens time of flight aberrations, the analyzer has higher acceptance in the Y-direction. WO2007044696 proposes using an orthogonal accelerator oriented in vertical Y-direction.

The ion mirrors employed in WO 2005/001878 are known to simultaneously provide second order time-of-flight focusing:

$$T|BB=T|BK=T|KK=T|YY=T|YK=T|YB=0 \quad (1)$$

with spatial confinement in the vertical Y-direction and with compensation of second order spatial aberrations after an even number of reflections:

$$Y|B=Y|K=0;\ Y|BB=Y|BK=Y|KK=0 \quad (2a)$$

$$B|Y=B|K=0;\ B|YY=B|YK=B|KK=0 \quad (2b)$$

combined with a third order time per energy focusing $$T|K=T|KK=T|KKK=0 \quad (3)$$

where the aberrations are expressed with the Taylor expansion coefficients, Y is vertical coordinate, B is the angle to axis, K is ion energy and T is the flight time.

In WO 2013/063587, the focusing properties of planar MRTOFs were improved by achieving third order full time-of-flight focusing, including cross terms:

$$T|BBK=T|YBK=T|YYK=0 \quad (4)$$

and by reaching up to fifth order time-per-energy focusing:

$$T|K=T|KK=T|KKK=T|KKKK=T|KKKKK=0 \quad (5)$$

Both spatial and time-of-flight aberrations of mirrors appear far superior compared to sector based TOF mass spectrometers, since sectors compensate for only first order aberrations, i.e. satisfy only equation 1 above.

Although ion mirrors provide advanced ion optical properties compared to sectors, the spatial focusing and image mapping properties of gridless planar ion mirrors were not appreciated and were not used for multiple practical reasons. The present invention may be embodied by the instrument described in relation to FIGS. 2A and 2B, wherein the ion mirrors are gridless ion mirrors.

Figure 3:
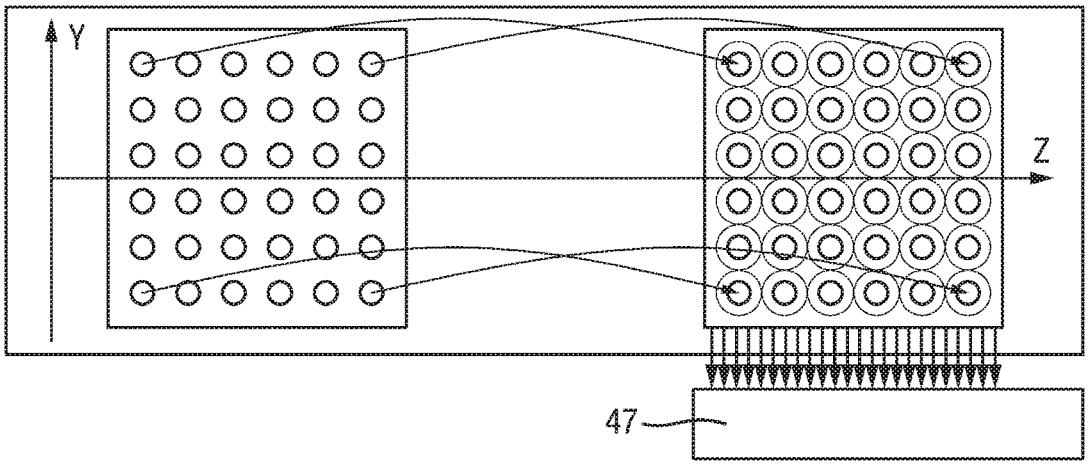
FIG. 3 schematically illustrates an analyzer of an embodiment of the present invention, wherein ions are transferred from pixels of an ion source array to corresponding pixels of an ion detector array.

FIG. 3 schematically illustrates the ability of analyzer to transfer ions from pixels of the ion source array 44 to corresponding pixels of the ion detector array 45. Pixelated detectors, such as those disclosed in U.S. Pat. No. 8,884,220, may be used to record time-of-flight signals from a matrix of individual pixels in the detector by using an array channel data system 47.

The spatial dimensions of the ion source array (i.e. view field) may be, for example, up to 7-10 mm and that the number of spots may form a 6×6 matrix, whilst retaining a mass resolution of approximately 100,000-200,000 for each individual pixel. The combination of a large field of view, and the spatial and mass resolutions provided is unprecedented and provides opportunities for high throughput mass spectrometric analysis. The analyzers may have a larger field of view and/or a larger source matrix density, such as a field of view up to 15-20 mm and/or a source matrix density of at least 10×10.

The mapping MRTOF described herein may be used for a number of applications. For example, the instrument may be used for crude surface imaging at a high throughput rate. Alternatively, or additionally, the instrument may be used for analyzing multiple samples deposited onto a surface as a macroscopic sample array. Such an analysis may be enhanced by sample micro-scanning within a pixel, i.e. within a sample well. The instrument may be used to analyze ions from multiple independent ionization sources, such as atmospheric or ambient sources, for high throughput analysis. For example, the instrument may analyze multiple sample spots ionized by ambient sources. A sample may be spatially separated by mass or mobility, and the instrument may be used for simultaneous parallel mass analysis of different separation fractions.

The ion mapping from the ion source to the detector may be performed in one dimension or in two dimensions. For example, in one dimensional ion mapping ions may be generated from multiple sample regions that are distributed along the Y-dimension (or Z-dimension) of the ion source, and these ions may be mapped onto the detector at respective multiple regions that are distributed along the Y-dimension (or Z-dimension) of the detector. In two dimensional ion mapping ions may be generated from multiple sample regions that are distributed in the Y-Z plane of the ion source, and these ions may be mapped onto the detector at respective multiple regions that are distributed in the Y-Z plane of the detector.

The field of view of an analyzer may be limited in both the Y- and Z-dimensions, before high order spatial aberrations degrade spatial resolution and cross-term aberrations degrade mass resolution. For example, the field of view may be 1 mm or less in any dimension. However, the position sensitive detector and/or the source array may occupy a relatively large area (e.g. larger than 1 mm in any dimension), or may have a relatively large (or small) pixel size. Also, the ion source and detector may be different sizes. The imaging and mapping system therefore may be subjected to a mismatch in spatial scales and/or a lack of space within the MRTOF analyzer to accommodate the source or detector. This may be accommodated for, as discussed further below.

Although the spatial resolution of the described embodiment is moderate in terms of number of resolved pixels, it is very unusual for TOF analyzers to sustain imaging properties at large fields of view in comparison to prior art TOF mass microscopes, in which the imaging field is well under 1 mm.

Due to the spatial resolution of the MRTOF, it can be seen that the ion packets land on separated spots of the ion detector. As a result, the analyzer transfers ions from a matrix of ion source spots to a corresponding matrix of spots on the detector. This system may allow independent acquisition of a matrix of ion beams or ion packets, with minimal ion losses and without any signal interference between individual pixels at the detector. This leads to an improvement in the analysis throughput. Although a 6×6 matrix of ion sources has been described, denser matrices and larger fields of view may be provided using the analyzer.

Figure 4A:
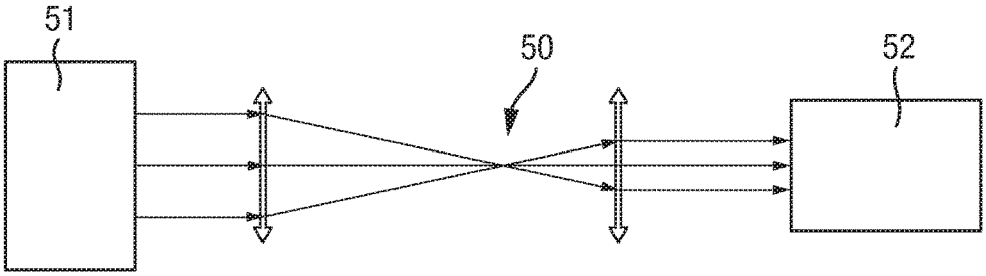
FIGS. 4A to 4C show telescopic and microscopic lens arrangements that may be used in the present invention.
Figure 4B:
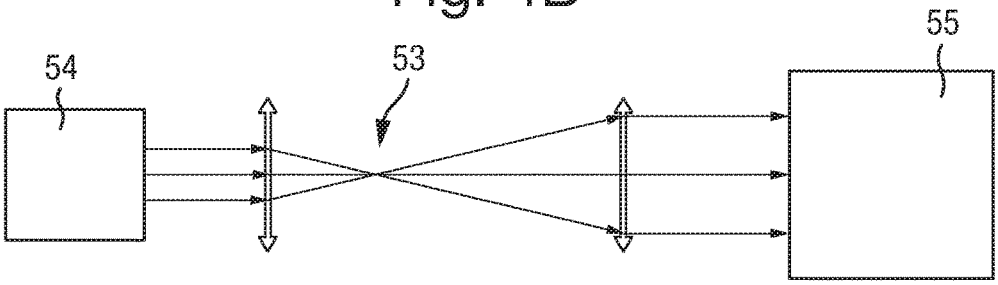
Figure 4C:
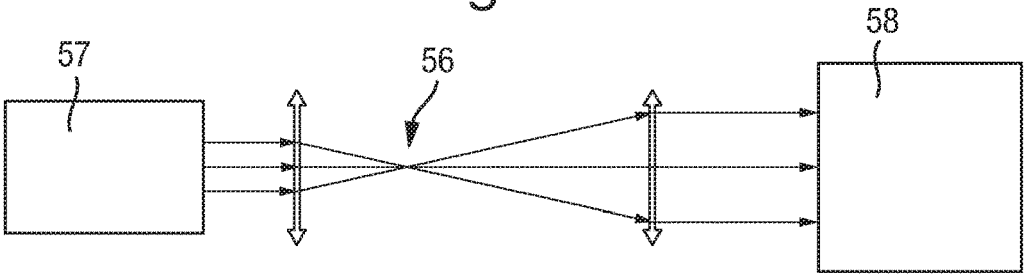

Telescopic (e.g. microscopic) ion optical sets, including lenses, mirrors or sectors may be used to map the ions from the source to the detector. FIGS. 4A to 4C show telescopic and microscopic lens arrangements that may be used.

FIG. 4A shows a schematic of a telescopic device 50 for interfacing a source array 51 that is relatively wide in the Y- and Z-dimensions to an analyzer having a detector 52 that is smaller in the Y- and Z-dimensions.

FIG. 4B shows a schematic of a microscope lens set 53 for expanding the ion beams from a source array 54 in the Y- and Z-dimensions. For example, the microscope lens set 53 may image a small surface with a field of view of about 1 mm in each of the Y- and Z-dimensions to a wider ion packet array within the analyzer 55, e.g. optimized to an array size of about 3-5 mm in each of the Y- and Z-dimensions.

FIG. 4C shows a schematic of a telescopic expander 56 for expanding the ion beams from a source array 57 that is relatively small in the Y- and Z-dimensions to an analyzer 58 having a detector that is larger in the Y- and Z-dimensions (e.g. 15-25 mm). Such a detector may be used to retain macroscopic pixels and handle larger ion fluxes.

Figure 5:
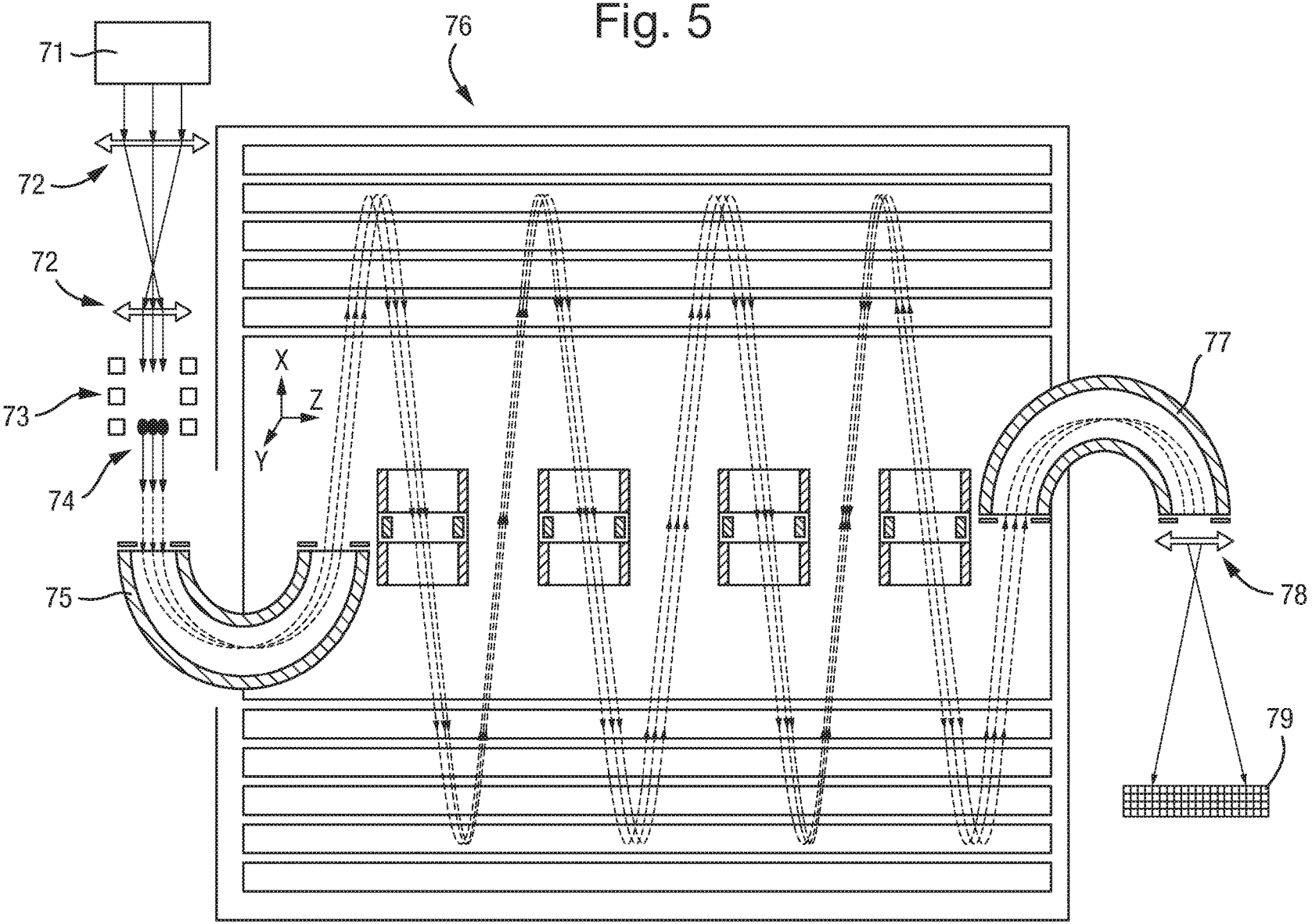
FIG. 5 shows a schematic of a spectrometer according to an embodiment of the present invention wherein electric sectors guide ions into and from a multi-reflecting time of flight region.

FIG. 5 shows an embodiment comprising a multi-beam ion source 71 for forming a 1D or 2D array of continuous ion beams. A static telescopic lens system 72 is provided for converting the beam array to a beam array having smaller dimensions. A beam converter 73 is provided for forming pulsed ion packets. An isochronous and imaging sector 75 is provided for transferring ion packets into the TOF region 76. The ions then separate according to time of flight in the TOF region 76. An isochronous imaging sector 77 is provided for guiding ions out of the TOF region 76 and through a magnifying lens 78 and then onto a pixelated detector 79. The use of sectors, such as electrostatic sectors, is particularly useful as it allows the ion source or detector to be moved externally from the MRTOF analyzer.

Both sectors 75 and 77 may be either cylindrical, torroidal or spherical, depending on whether 1D or 2D ion mapping is desired. A cylindrical sector may be used for 1D mapping, or torroidal or spherical sectors may be used for 2D mapping. The sectors may be combined with electrostatic lenses. Both sectors may be composed of several sector sections for optimal spatial resolution and isochronicity. The sector steering angles may be optimized depending on the overall arrangement, for example, as described in WO 2006/102430.

Electrostatic sectors serve multiple functions. They allow a relatively large ion source array and detector to be arranged outside of the MRTOF, whilst introducing ions into and extracting ions from the TOF region. Also, sectors are capable of removing excessive energy spread of the ions so as to optimize spatial and mass resolution with only moderate ion losses. Sectors may also be used as part of telescopic arrangements for optimal adoption of spatial scales between the ion source, the TOF analyzer and the detector.

In the analyzers of the embodiments described herein, spatial resolution may be primarily limited by high order spatial aberrations, such as spherical aberration Y|YYY or view-field curvature Y|BBY, or by other high order cross-aberrations including energy terms. Thus, spatial resolution is expected to improve at smaller ion trajectory offset and smaller view field. The smaller view field may be magnified with telescopic lenses or sectors, also may incorporate diverging trajectories of the MRTOF analyzer, as has been described in relation to FIG. 4.

Although only the use of planar ion mirrors for the TOF region have been described above, it is contemplated that other geometries may be employed.

Figure 6:
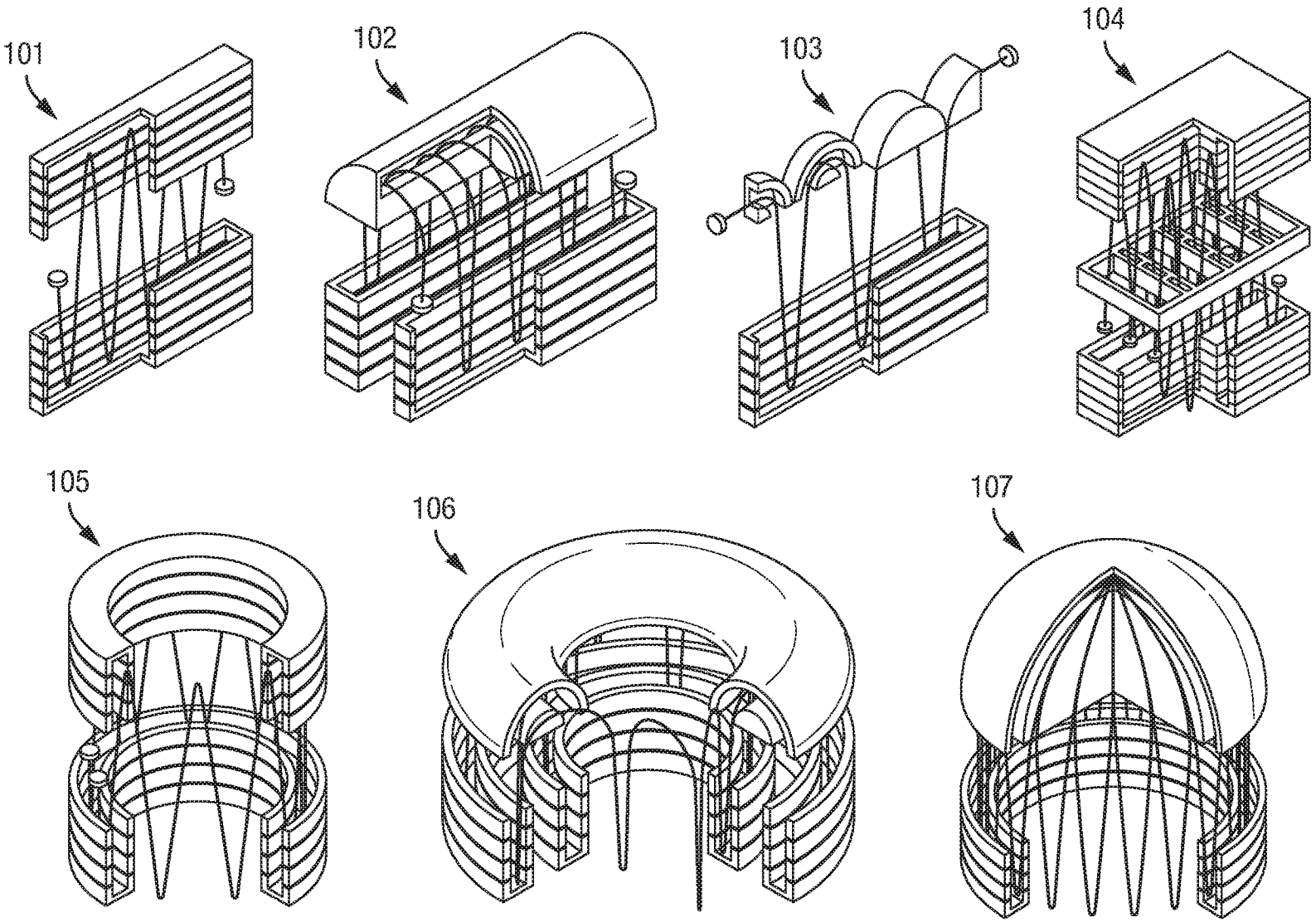
FIG. 6 shows various different topologies that may be used to form electrostatic fields in the time of flight region of the embodiments of the present invention.

FIG. 6 shows various different topologies of planar and curved electrodes that may be used to form two-dimensional electrostatic fields for use as the TOF regions in the analyzers of embodiments. These topologies may be used to provide the ion mapping properties described above, whilst providing denser packaging of ion trajectories. It may be desired for the analyzers to combine both sectors and ion mirrors, since ion mirrors are capable of compensating for multiple sector aberrations. Combined (hybrid) systems may have similar ion optical properties to systems built from only ion mirrors.

The topology labeled 101 schematically illustrates the electrode arrangement for the planar MRTOF that has already been described above, having two parallel, straight ion mirrors. The topology labeled 102 schematically illustrates the electrode arrangement for a hybrid folded analyzer having a sector that guides ions between two ion mirrors. The topology labeled 103 schematically illustrates the electrode arrangement for another hybrid system built using multiple sectors and an ion mirror. The topology labeled 104 schematically illustrates the electrode arrangement for another analyzer that may be used for multiplexing, e.g. as described in WO 2011/086430. The topology labeled 105 schematically illustrates the electrode arrangement for an analyzer that is similar to topology 101, except that the mirrors are cylindrically wrapped. The topology labeled 106 schematically illustrates the electrode arrangement for an analyzer that is similar to topology 102, except that the mirrors and sector are cylindrically wrapped. The topology labeled 107 schematically illustrates the electrode arrangement for an analyzer that is similar to topology 105, except that the upper mirror is replaced by a spherical sector. The illustrated instruments having mixed symmetry and employing curved ion trajectory axes provide compact analyzers and allow geometrical up-scaling at a given instrument size. Ion mapping and imaging properties, as with TOF resolution, are rapidly improved with the analyzer up-scaling due to the fast reduction of high order aberrations.

As described above, the pixelated detector may provide independent mass spectral analysis for each individual pixel, or groups of pixels in the ion source. Prior art ion mapping instruments typically have a field of view with each dimension under 1 mm. In contrast, the embodiments described herein may provide instruments having lower resolution ion mapping but with a much larger field of view, such as up to 10×10 mm in combination with parallel (simultaneous) acquisition of high resolution mass spectra for all mapped pixels. The mass spectral mapping of macroscopic size spots (e.g. spots having a dimension in each direction of 1-2 mm) allows the opportunity of parallel and independent analysis for multiple ion sources, either from 1D or 2D arrays.

Various methods and apparatus are contemplated herein for miniaturizing ion source arrays, ion transfer arrays, ion optics arrays, and forming appropriate pulsed converters for such arrays, enabling multi-channel MRTOF with high throughput analysis.

The mapping MRTOF described herein allows parallel analysis of multiple ion flows. Various arrays of ambient ion sources are known, although they are conventionally multiplexed in an atmospheric or vacuum interface for analysis in a single channel mass spectrometer. In contrast, the ion source arrays may be used in the present invention for parallel analysis and hence the instrument provides a much higher throughput than prior art instruments.

Figure 7A:
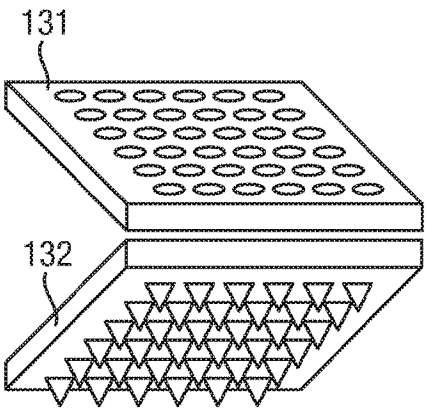
FIGS. 7A-7C and 8A-8C show various arrays of ion sources that may be used in the embodiments of the present invention.
Figure 7B:
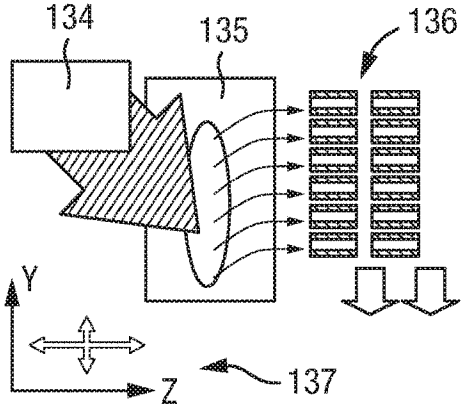
Figure 7C:
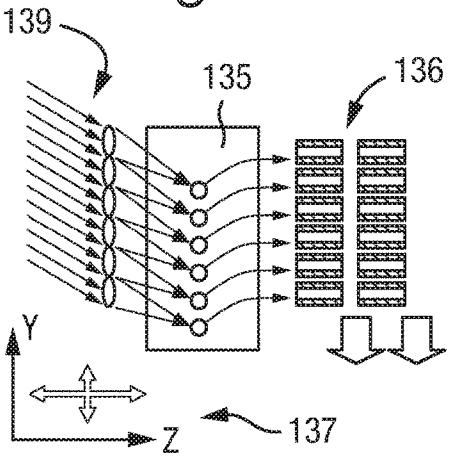

FIGS. 7A-7C show various arrays of ion sources that may be used with the mapping MRTOF. The ion source may comprise an array of independent ion sources, such as ESI, APCI, APPI, CGD, DESI, DART, or MALDI ion sources. Each array may comprise multiple ion sources of the same type or of different types. The arrays of ion sources may operate at atmospheric pressure, or at lower pressures, such as 1-100 Torr gas pressure, e.g. in the case of gaseous MALDI ion sources or conditioned glow discharge (e.g. as described in WO 2012/024570). The ion sources in any given ion source array may ionize multiple different samples simultaneously and therefore may provide the instrument with a high throughput. The ion sources in any given ion source array may be connected to multiple samples, e.g. to multiple chromatographic channels or may be used for surface imaging at ambient gas pressure.

Different types of ion sources may be used in any given array of ion sources. The ion sources may be used for the simultaneous analysis of the same sample, for example, for obtaining additional information due to variations in softness, charge states, selectivity, fragmentation patterns, variations in discrimination effects, or for calibrations in mass, intensity or at quantitative concentration measurements.

FIG. 7A shows a schematic of an ion source array comprising an array of ESI spray micro-tips 132 connected to a multi-well sample plate 131. The sample flow to spray tips 132 may be induced by pressurizing the sample with gas. If a relatively large array dimension is used (e.g. 386 wells), the well plate 131 may be incrementally moved across the array of sampling nozzles 132.

In one example of practical importance, the instrument may be used for proteomic analyses. State of the art proteomic analyses with single channel LC-MS-MS may last for several hours, as several thousand runs may be required for each study. For higher throughput the multi-channel MRTOF described herein may be used. The proteomic samples may be pre-separated, e.g. by affinity separation or salt exchange chromatography and prior to the step of enzymatic digestion. Then separated fractions may be analyzed in parallel using multiple independent LC-MS channels or LC-$MS^E$ channels (more preferable), whilst using a single mapping MRTOF mass spectrometer as described herein. Compared to the conventional single channel LC-MS-MS experiment, the MRTOF is expected to obtain more information per sample (e.g. in research programs) or obtain the same information at much faster LC gradients (e.g. for high throughput clinical analysis). Alternatively, multiple proteomic samples may be analyzed in parallel for higher throughput with a LC-$MS^E$ method. Higher throughput may also be highly desirable for other LC-MS and GC-MS analyses in clinical, environmental, and metabolomic studies.

FIG. 7B shows a schematic of an ion source array for 1D array flow sampling. The ion source may be used for ambient surface imaging. A DART or DESI flux 134 of primary particles (e.g. charged droplets or metastable Penning Argon atoms) may be used to ionize a sample or samples over a relatively large sample surface 135. A linear array of nozzles 136 may be provided to sample ions from a linear array of parallel surface pixels on the target surface 135. The spatial resolution (i.e. pixel size) is defined by the size of ion collection into each nozzle, typically being about 3 times larger than the nozzle diameter. The nozzle diameter may be chosen to be 0.1-0.3 mm for a spatial resolution of 0.3-1 mm. As the 1D array of nozzles collects ions from a strip along the target surface 135, the sample plate may be scanned across the entrances to the nozzles. The resolution of the surface imaging may be somewhat improved with sample plate scans 137. The array analysis notably accelerates the surface analysis with DART and DESI, which is slow with existing single channel mass spectrometers.

FIG. 7C shows a schematic of another ion source array. The spatial resolution of the ambient surface analysis may be enhanced in this embodiment by using an array of small size ionizing beams, such as focused laser beams 139. The laser beams 139 may be produced using an array of micro-lenses or using interference of coherent laser beams. The sample plate may be scanned across the laser beams, or vice versa. For example, each laser beam may be scanned across the target plate within a portion corresponding to a pixel on the target plate. This embodiment provides parallel analysis of the source array with ion mapping to the detector and high mass resolution.

Figure 8A:
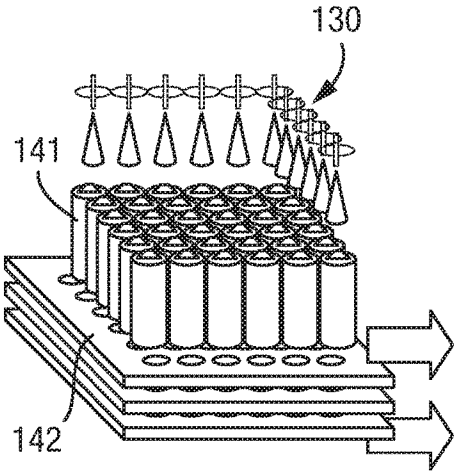

FIG. 8A shows a further embodiment of the source array. In this embodiment, ESI spray tips 130 are assisted with focusing electrodes in order to provide sharper focused ESI plumes. Ion flows from multiple sources 130 are sampled by electric fields and by gas flow into an array of heated capillaries 141. The heated capillaries may have sharp tips or cones with sampling apertures at their tops. The ions may then be transmitted into and confined in channels 142. The channels may be defied by apertured plates and RF potentials may be applied to these plates so as to confine the ions in the channels.

A capillary diameter of about 0.5 mm nay be used for higher sensitivity, leading to approximately 1 L/s gas flux through the 36 channels. A mechanical pump (e.g. a scroll pump) may be used to evacuate a large gas flux past the capillaries, for example with a pumping speed above 30 L/s, as shown by white arrows. This brings the gas pressure down to under 30 Torr, i.e. into the range for effective RF confining within RF channels 142.

Figure 8B:
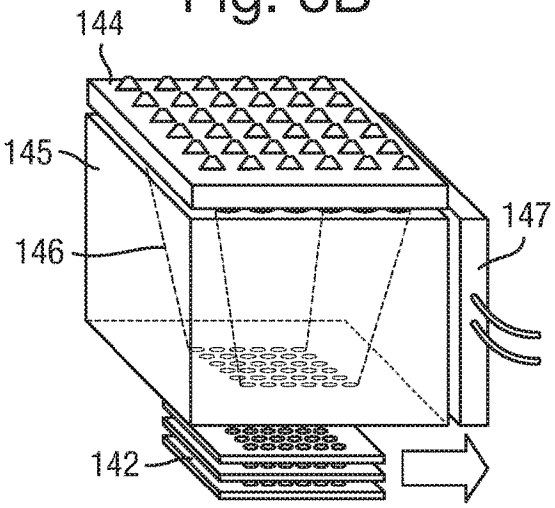

FIG. 8B shows a further embodiment of the source array wherein the sampling plate 144 comprises sharp cones with relatively smaller sampling nozzles apertures, limiting the sampled gas flow. Ions are further sampled by gas flow into relatively wider channels 146 that may be machined in a heated block 145, for example by point EDM. Once gas flow is limited by apertures of sampling plate 144, the internal part of the block 145 may be constructed of split pieces, for example, from plates, cylinders, cones, or wedges, for ease of making channels 146 and for cleaning.

The nozzle spacing may be spread spatially for efficient sampling from an array of multiple macroscopic ion sources, while channels 146 may converge towards the exit. Since ion collection diameter may be desired to be at least three times the nozzle aperture diameter, for imaging applications, the nozzle diameter could be reduced, for example, to 0.3 mm so as to reduce the gas load through the nozzle array, which may be about 0.4 L/s for 36 channels. A single mechanical pump pumping at 10 L/s may be provided to drop the gas pressure to under 30 Torr. Even lower gas loads may be provided by using finer nozzles for surface imaging at higher spatial resolutions.

Figure 8C:
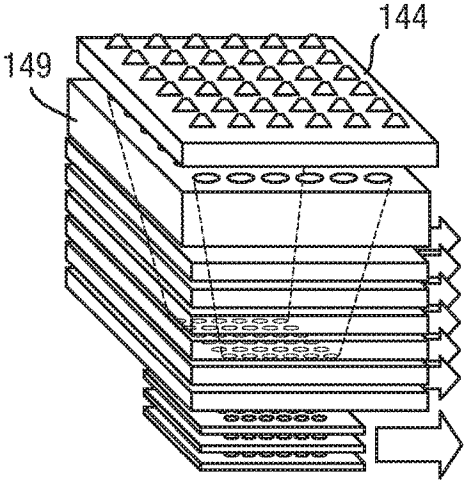

FIG. 8C shows a further embodiment of the source array that is similar to that of FIG. 8B, except that a sectioned nozzle array 149 is provided with distributed pumping, as shown by the white arrows. If a relatively large number of channels (e.g. 100) are used or larger nozzle apertures are used (e.g. for improved sensitivity), the nozzle array 149 may comprise two or more aligned stages of heated channels with differential gas evacuation in between the stages. Ion transfer between the stages may be assisted by gas dynamic focusing of ions on the axis of each heated capillary and/or by electrostatic focusing onto sharp capillary tips of the second stage. Alternatively, the nozzle array may comprise perforated apertures with alternated DC potentials and with distributed pumping between the plates. Gas jets formed on the axis of each channel will transfer ions at nearly sonic speed this way, generating the time alternated force required to provide spatial confinement of ions to the axis.

It is desired to form ion beams and ion packets, e.g. for small size arrays.

Figure 9C:
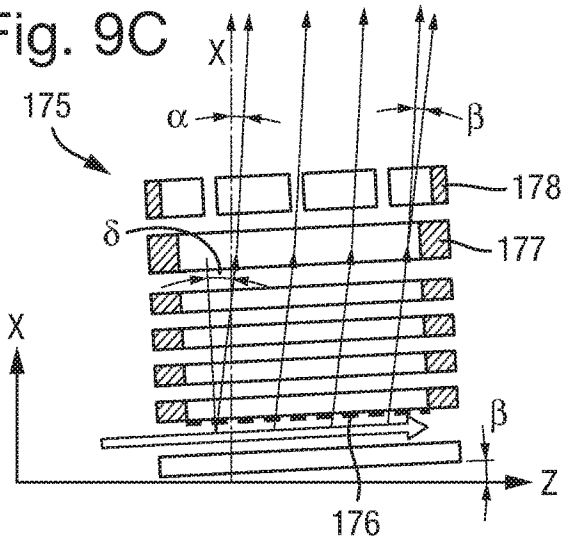
FIGS. 9A-9C show a schematic of an instrument according to an embodiment of the present invention for mapping ions from a 1D array of ion sources to a detector.
Figure 9A:
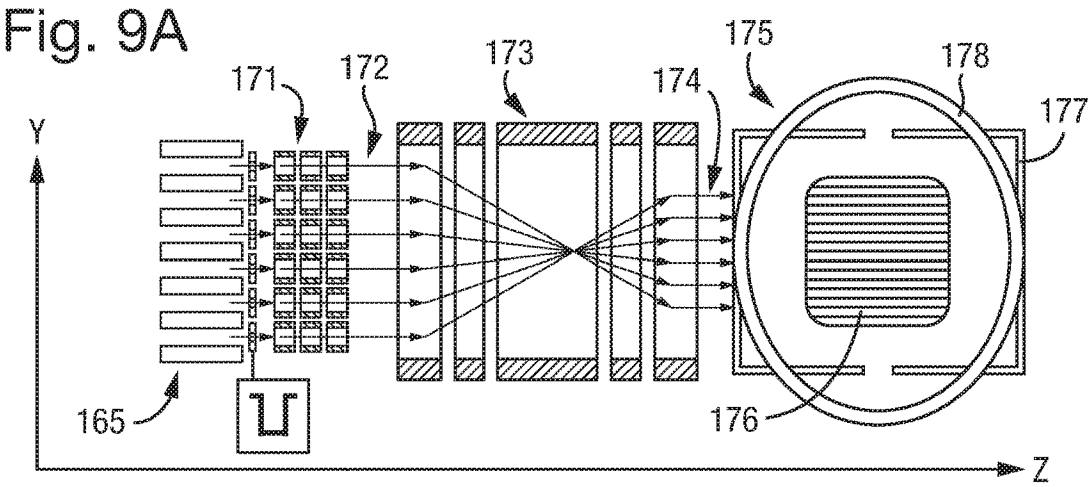
Figure 9B:
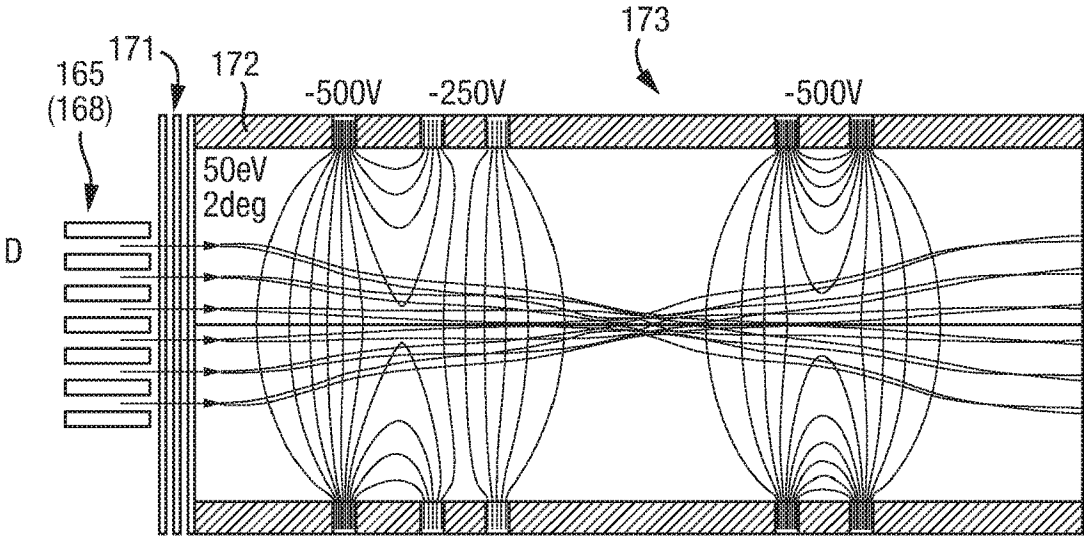
Figure 9B:
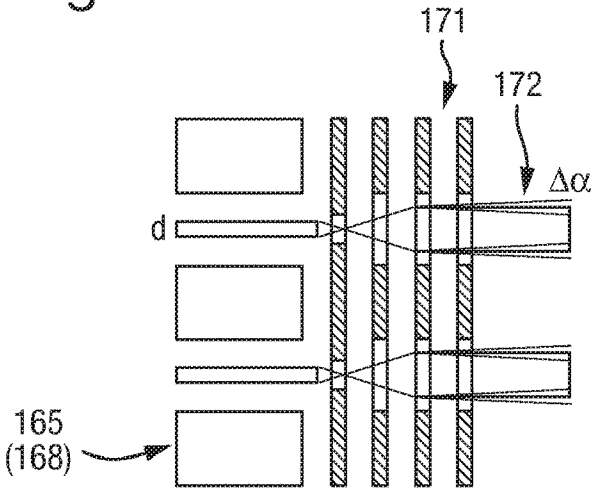

FIGS. 9A-9C depict a schematic of a multi-channel MRTOF having a 1D array of ambient ion sources and configured to perform 1D ion mapping onto the detector 175. As shown in FIG. 9A, the instrument comprises a 1D array of RF quadrupoles 165, a set of micro-lenses 171 for forming a low divergence beam array 172, a telescopic lens 173 (e.g. having a magnification of one, or having size compression), an orthogonal accelerator 175 with a wire mesh 176, a lens 178 terminating the field of the orthogonal accelerator 175, and a sectioned deflector 177.

FIG. 9B depicts the ion focusing downstream of the quadrupole array 165 by micro-lens 171. In this example, the pitch of quadrupole array is 2 mm with inscribed diameter of each quadrupole being 1.4 mm. An RF signal of 5 MHz with an amplitude of 300-500V is used to compress the ion flow to a diameter under d=0.1 mm. The ion flow is refocused at the electrostatic extraction point by an exit skimmer (the first set of apertures downstream of the quadrupole array), and is then expanded to a diameter of approximately D=0.5 mm within the micro-lens 171. The micro-lens array 171 with 1 mm diameter apertures accelerates ions to an energy eU=50 eV and forms wider but less divergent ion beams 172. The beam expansion D/d=5 causes a proportional reduction of ion beam angular divergence. The angular divergence $\Delta\alpha$ of thus formed ion beams may be estimated as 2*(kT/eU)^0.5*D/d and is approximately $\Delta\alpha$=10 mrad, i.e. half a degree. Without the micro-lens, the divergence would be 2.5 degrees. The reduction of the angular divergence of the beams serves two important purposes: it reduces ion beam interference at mapping, and it proportionally reduces the turn-around time in the orthogonal accelerator 175.

The array of ion beams then enters the telescopic lens 173. The telescopic lens is used for delivering narrow ion beams into the orthogonal accelerator 175, thus preserving ion beam separation. The telescopic lens also interfaces the spatial scale of the ion source to MRTOF field of view. For example, a 20 mm wide beam array may be compressed into a beam array within the accelerator 175 that is 7-10 mm wide. The icon 173 illustrates a particular example of the telescopic lens with unit magnification. The view is compressed about twice in the Z scale. The lens is 120 mm long and with a 30 mm inner diameter. The beam array is refocused by two lenses without any additional spreading of beam width, despite an initial divergence angle of 2 degrees. The telescopic lens may be tuned to provide spatial ion beam refocusing in the middle of the accelerator 175. Without the telescopic lens, the ion beams would spread for 1 mm while passing into the accelerator, which must be spaced from the quadrupole array, at least for reasons of differential pumping.

The orthogonal accelerator 175 shown in FIG. 9C is designed to accept a wide (e.g. 10 mm) array of ion beams while minimizing angular ion scattering if using any mesh.

The intermediate stages of the accelerator 175 may employ a mesh 176 made of wires oriented along ion beams, but may use an accelerating field of equal strength around the mesh to minimize the ion scattering on the mesh. The exit stage of the accelerator may be terminated by a wide open lens 177 to avoid angular ion scattering. Any ion beam angular focusing is accounted for and balanced with other spatially focusing elements of the MRTOF, e.g. either the ion mirror 21 or periodic lenses 23 of FIG. 2 or 5.

The ion beams at the entrance of the orthogonal accelerator 175 may have a diameter under 1 mm, a mean ion energy of 50 eV, and an angular divergence of about 0.5 degrees. In order to provide a short sub-nanosecond turn-around time, the accelerator may be arranged with a large extraction field, e.g. 300-500 V/mm, thus creating an energy spread of about 300-500 eV.

In order to handle ion packets having a large energy spread, the MRTOF may be operated at the highest practical acceleration voltage applied to drift region, e.g. −8 to −10 kV. The natural inclination angle of ion trajectories is $\delta$=70 mrad (square root of energies 50 eV and 10 keV). In case of orienting ion beams along the Z-direction, and if no measures are taken, the ion packet advance would appear too high, i.e. 70 mm per mirror reflection, which would require an MRTOF having a large width in the Z-direction. To drop the inclination angle $\beta$, the orthogonal accelerator 175 is tilted at the angle $\beta$, and the packets are then steered by a deflector for the same angle $\beta$. The deflector 178 may be composed of several sections for a more uniform deflection field. The ion beam energy at the accelerator entrance may be adjusted so that both the tilt and steering provide mutual compensation of the first order time aberration, as described in WO 2007/044696. In the chosen example of $\delta$=70 mrad, $\beta$=20 mrad, a resultant inclination angle of $\alpha$=30 mrad, at 5% relative energy spread, and if using ion packets under 25 mm length, the amplitude of residual second order aberration T|ZK stays under 1 ns with the peak FWHM being under 0.25 ns. With the chosen Z-pitch per ion reflection of 30 mm, the practical ion packet length is expected about 15 mm. At 50 eV ion energy, ions of 1000 amu travel with speed of 3 mm/μs and traverse the useful extracted 15 mm portion of continuous packet within 5 μs time.

Figure 10:
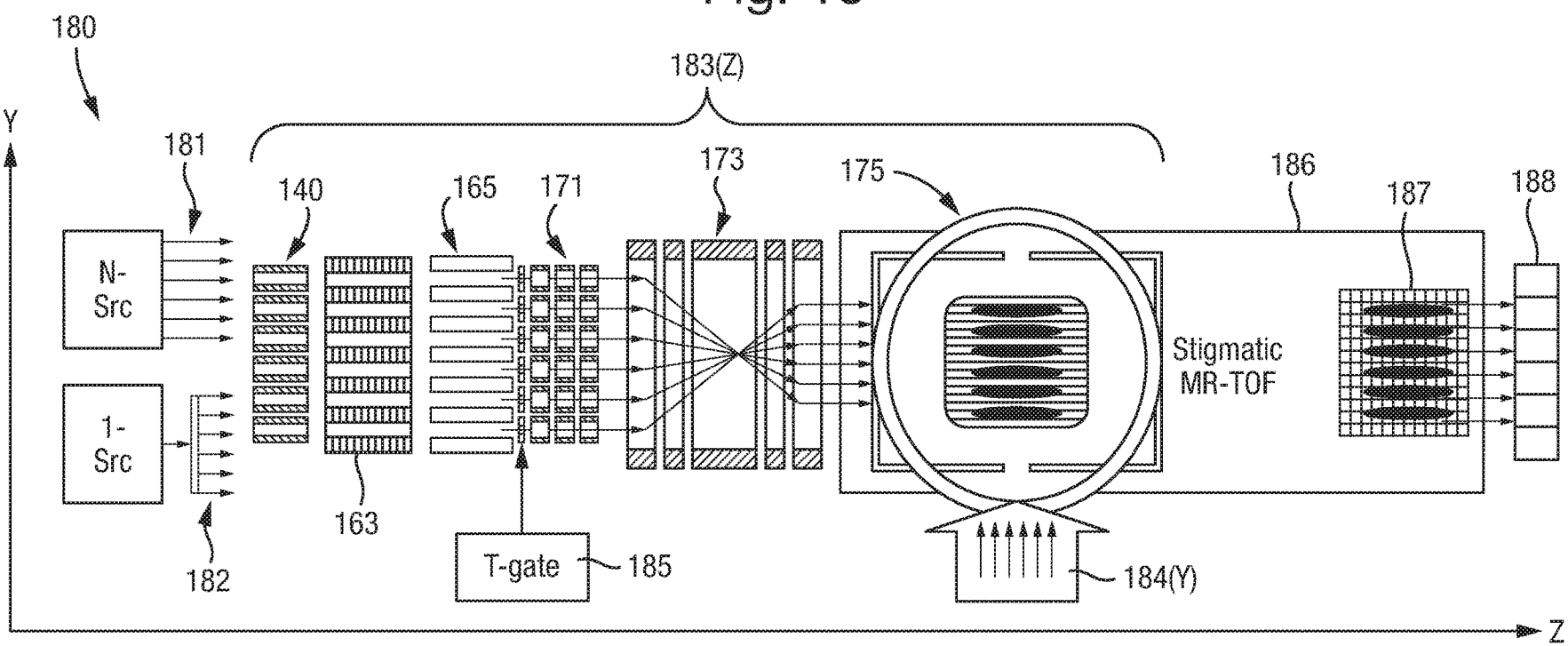
FIG. 10 shows a schematic of another instrument according to an embodiment of the present invention for mapping ions from a 1D array to a detector.

FIG. 10 shows an embodiment 180 of 1D multi-channel MR-TOF. The MRTOF instrument may comprise an array of ambient ion sources forming an array of ion flows 181, or may comprise a single ion source producing a single ion flow that is then split into multiple ion flows 182. The instrument comprises a multi-channel interface 183, oriented along the Z-axis, or a similar multi-channel interface 184 being oriented along the Y direction. The instrument comprises a 1D or 2D imaging MRTOF analyser 186, as described herein, and a pixelated detector 187 that is connected to a multi-channel data acquisition system 188.

The array interfaces 183 or 184 may comprise a nozzle array 140 of type described above, an array of RF ion guide channels 163, an array of RF quadrupoles 165 having exit skimmers (optionally connected to pulse generator 185), an array of micro-lens 171, a telescopic lens 173, and an orthogonal accelerator 175.

In one, continuous mode of operation, ion flows 181 may be separately transferred from individual ion sources, through individual channels of interface 183, into the orthogonal accelerator 175 as spatially separated ion beams. Each of the ions beams is then converted into spatially distinguished ion packets, elongated in the Z-direction and narrow in the Y-direction. The mapping MRTOF 186 transfers ion packets to the pixelated detector 187 without mixing the packets. The pixels of data system may be combined into strips along the Z-direction, and data system 188 may acquire multiple mass spectra in parallel, for each channel. The MRTOF 180 effectively forms an array of parallel operating mass spectrometers, while sharing a common vacuum chamber, differential pumping system, electronics and unifying analytical components, e.g. including making multiple apertures in one block rather than making multiple blocks for the nozzles, RF ion guide channels, RF quadrupoles, and ion optics.

In another operational mode, extraction pulses are applied (from block 185) to the exit skimmers of the RF quadrupoles 165 in a manner that traps and releases ions in the RF quadrupoles. The pulses of the orthogonal accelerator 175 are synchronized in time with the pulses of the ions from the quadrupoles. A single pulse may be applied to the quadrupoles and the orthogonal accelerator in order to analyze ions from all channels simultaneously. This method enables an improvement in the duty cycle of the accelerator, though at the expense of a narrower mass range being admitted in each pulse. It is also contemplated that the timing of the extraction pulses 185 may vary between channels or between accelerator shots. This may be used to admit a wider overall mass range, or optimize the delay for the expected mass range of a particular quadrupole channel. The pulsed ion release may also be used to form a crude mass separation in the second direction, along the ion beams. The two dimensional pixelated detector may thus detect a narrow mass range per pixel, which reduces spectral population per pixel.

Figure 11:
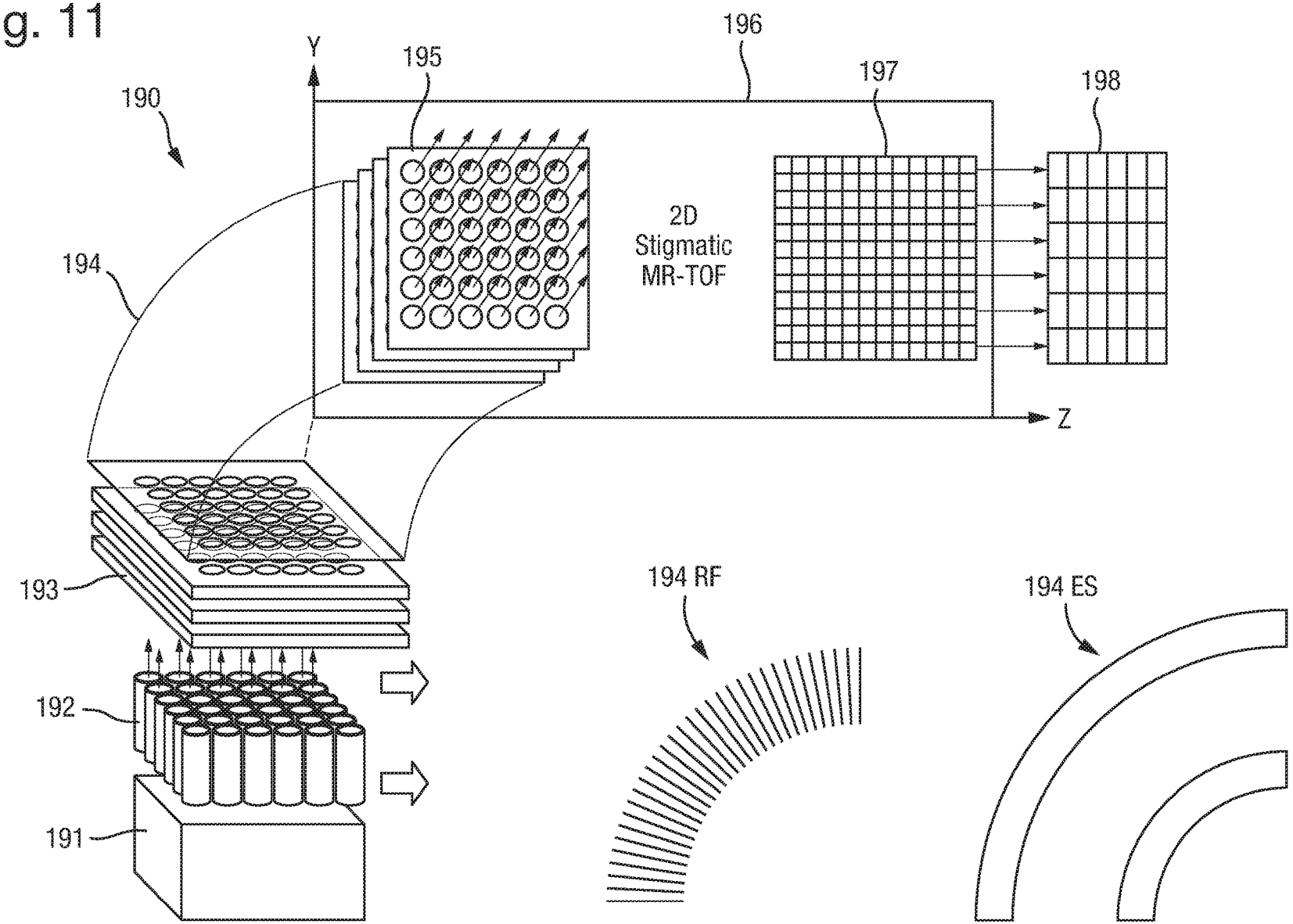
FIG. 11 shows a schematic of an instrument according to an embodiment of the present invention for mapping ions from a 2D array to a 2D detector.

FIG. 11 illustrates a MRTOF for performing two-dimensional mapping. The 2D Multi-channel MRTOF 190 comprises a 2D array of ambient sources 191, a 2D nozzle array 192, a 2D array of RF ion guide channels 193, a 2D curved interface 194; a 2D array pulsed converter 195, a 2D imaging MRTOF analyzer 197, a 2D pixelated detector 197, and a 2D array data system 198.

The 2D array of ambient sources 191 may be of the type described herein above, e.g. in the form of a 2D array of spray tips 130. The 2D nozzle array 192 may be of the type described herein above, e.g. in the form of capillary array 141 and heated block 143 with machined channels (optionally a split heated block 148 of plates with channels). The curved interface 194 may be a 2D array of RF ion guide channels (194 RF), e.g. composed of mutually tilted perforated plates or PCB boards. Alternatively, the curved interface 194 may be a 2D array of electrostatic sectors (194 ES) for bypassing fringing fields of the ion mirrors, e.g. as described in U.S. Pat. No. 7,326,925 (X-inlet). The curved interface 194 allows the ion source array to be located externally to the MRTOF analyzer such that it does not interfere with the MRTOF analyzer.

Compared to ambient sources, arranging an array of vacuum ion sources is the task of relatively lower complexity, since vacuum ion sources do not require multi-channel ion transfer interfaces and a powerful pumping system. The task is even simpler if using naturally pulsed ion sources, like pulsed SIMS, MALDI or DE-MALDI.

Figure 12A:
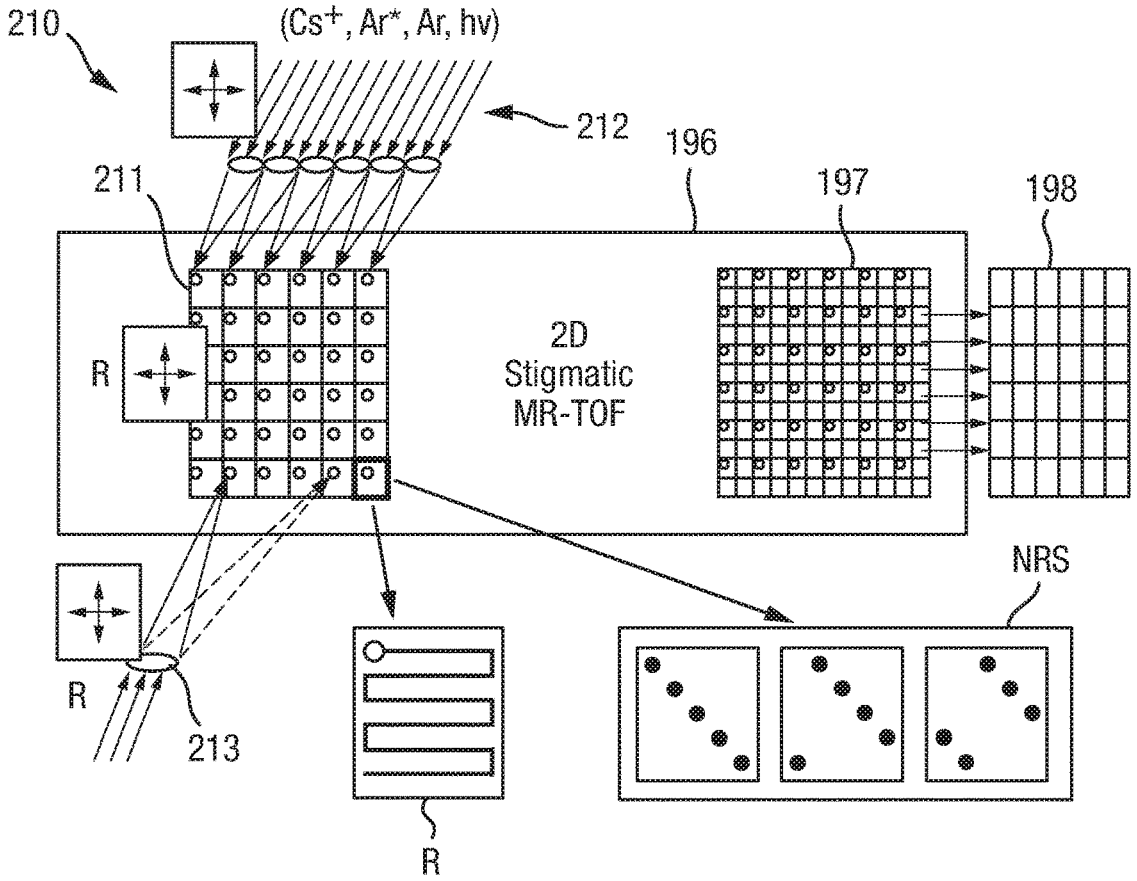
FIG. 12A shows a 2D mapping instrument having an array of pulsed vacuum ion sources.

FIG. 12A shows an embodiment of a 2D mapping MRTOF having an array of pulsed vacuum ion sources 210. The instrument may comprise a mapped target plate 211, which may be a mapped sample or a multi-well sample plate. An array of focused primary ion beams 212 may be directed onto the target plate 211 in order to ionize the sample thereon. Alternatively, an array of laser beams may be used to ionize the samples on the target plate 211. Different ion beams or laser beams may be directed onto different regions of the target plate 211 in order to ionize different areas/pixels on the target plate 211. Alternatively, a laser beam such as a scanning focused beam 213, may be scanned across the target plate to ionize the sample thereon. The beam may be scanned across the target plate so as to ionize different areas/pixels at different times. The instrument further comprises a mapping MRTOF analyzer 196, a pixelated detector 197, and a multi-channel data system 198 for parallel mass spectral acquisition.

As described above, a variety of vacuum ion sources may be used. For example, when a plurality of laser beams are used to ionize the sample, an array 212 of fine-focused primary laser beams may be provided from a single, wide laser beam with the aid of multiple UV lenses or by an array of concave reflectors. When a single laser beam 213 is scanned across the target plate to ionize the sample, this may be performed with galvanic fast-moved mirrors. The laser beam(s) may be pulsed for MALDI, LD or DE MALDI ionization. When ion beams are directed at the target plate to ionize the sample, an array 212 of primary ion beams (e.g. for SIMS ionization) may be formed by an array of electrostatic micro-lenses. The primary ion beams 213 may be scanned across the target plate in a stepped or continuous and smooth manner. The ion beams may be scanned in at least one direction by electrostatic deflectors.

When pulsed ionization is performed (e.g. SIMS, MALDI, DE MALDI, or LD), and when mapping within a wide field of view, the secondary ions (i.e. analyte ions) may be focused by an array of micro-lenses, optionally followed by a single wide aperture telescopic lens such as the type described in relation to FIG. 9. As the primary beams may be focused to a much finer spot size (e.g. 10-100 μm) as compared to pixel size (e.g. 0.1-1 mm), the sample plate and/or ion beams and/or laser beam(s) may be micro-scanned (e.g. rastered) within sample pixel boundaries, as illustrated by arrows and "R" icon in FIG. 12. Where multiple ion or laser beams are used to ionize the sample, the ion or laser beams may aligned in a 1D array on the target plate that extends in a first direction, and the 1D array may be scanned or stepped across the target plate in a second (e.g. orthogonal) direction.

Figure 12B:
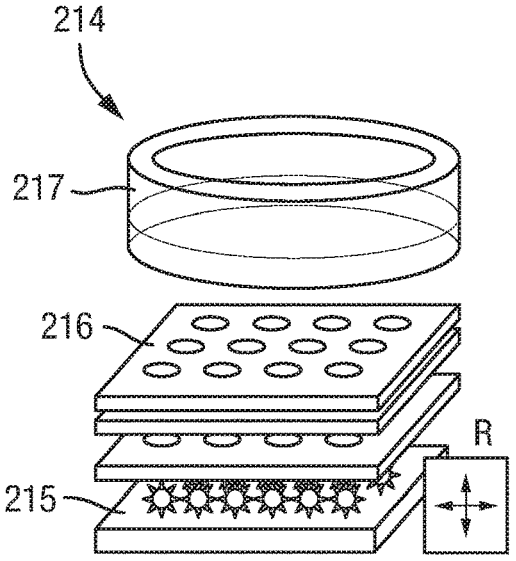
FIG. 12B shows an embodiment that uses a mask for separating individual secondary ion beams emitted from an ion source target plate.

FIG. 12B shows an embodiment 214 that uses a close view mask 215 for separating individual secondary ion beams emitted from the target plate, e.g. if a continuous glow discharge ionization process is used. The spatial focusing of individual ion beams may be assisted by a micro-lens array 216 that may be followed by a large aperture single lens 217. Ion packets may be formed by pulsed acceleration past the mask 215.

The parallel analysis by mapping multiple spots in a vacuum highly accelerates the analysis throughput. Using relatively fine ionizing beams in a vacuum allows multiple strategies for high spatial resolution for large overall sample sizes.

As described above, the primary beam 213 may be rastered across the target plate. Rastering the primary beam 213 may be of assistance where the dose of the primary beam is limited by the sample stability. Rastering of the primary beam may be performed at a faster time scale than the period of the pulsed acceleration. In this manner, a single ion beam effectively acts as multiple beams. The rastering may use stepped selection of ionization spots, rather than smooth scanning. For higher throughput at high spatial resolution, the primary beam spots may be selected with a strategy of non-redundant sampling (NRS), e.g. as described in WO 2013/192161 and depicted by icon 215. The combination of spots within a pixel/area may be varied between acceleration pulses. The signal on the detector may be acquired as a data string without losing time information. The mass spectrum for a particular fine spot may then be extracted by correlation with the position of the spot. For practical convenience, the encoding pattern may be the same for all pixels and may be performed with surface 2D stepped rastering.

The resolution of MRTOF devices is limited by the initial parameters of the incoming ion beam. For pulsed acceleration of the ions, the angular divergence of a continuous ion beam introduces velocity spread $\Delta V$ in the TOF direction, which leads to so-called turn-around time $\Delta T$. The time spread $\Delta T$ could possibly be reduced by using higher strength accelerating pulsed fields E, since $\Delta T=\Delta V*m/qE$. However, unfortunately the field strength is limited by the energy acceptance of the analyzer $\Delta X*E<\Delta K$. Thus, the ion beam emittance $Em=\Delta X*\Delta V$ limits TOF MS resolution. The problem may be solved by using finer size quadrupoles, however, this requires the use of multiple quadrupoles to avoid space-charge expansion of the ion cloud at practical ion currents of several nA to tens of nA.

Figure 13:
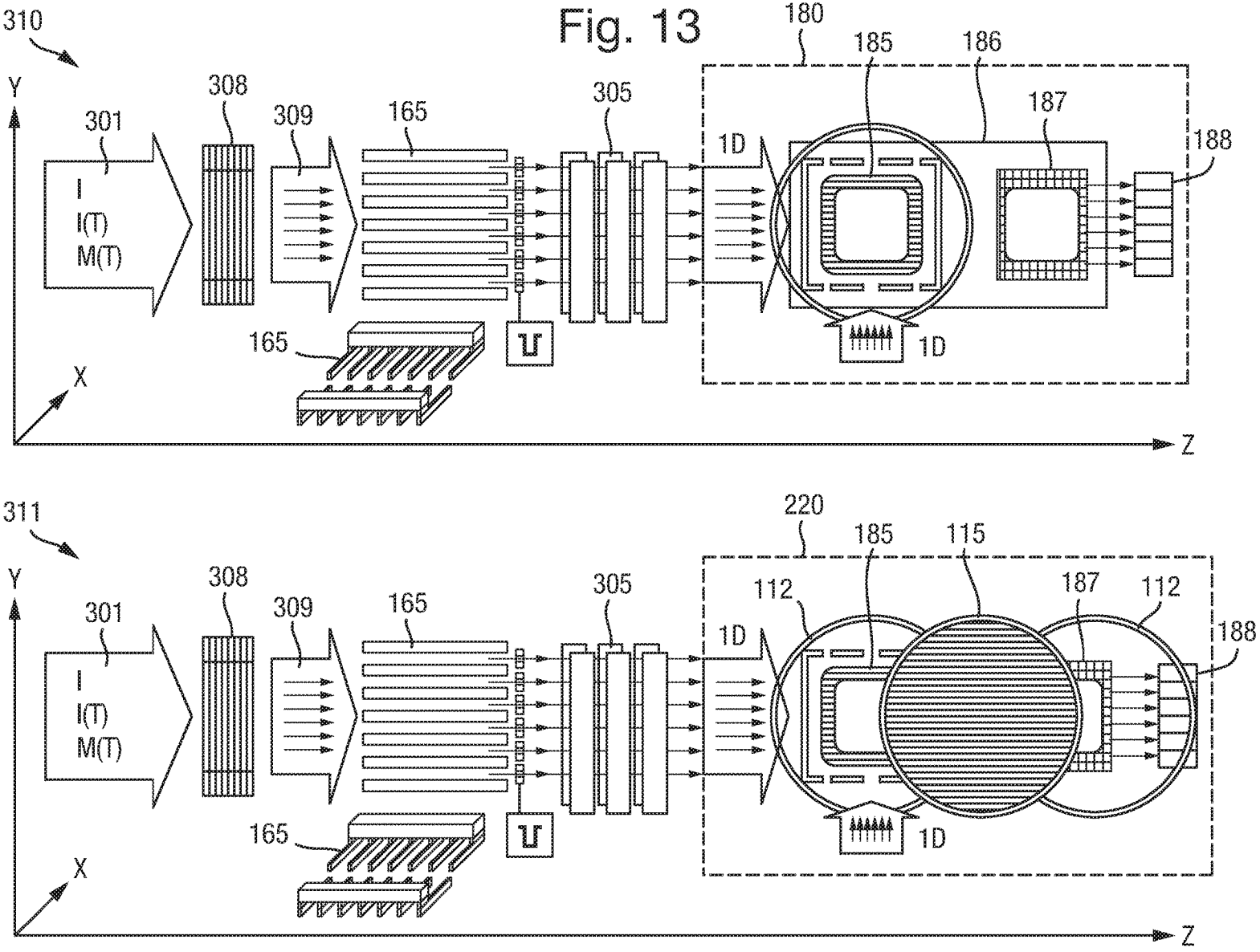
FIG. 13 illustrates an embodiment comprising a single source, a distributing RF guide and a 1D array of RF quadrupoles.

FIG. 13 illustrates an embodiment comprising a single source 301, a distributing RF guide 308, 1D array of small quadrupoles (RFQ) 165, a planar lens 305; and either a mapping MRTOF 180 or a mapping Re-TOF 220. In operation, a single ion flow (e.g. up to a few nano-Amperes for LC-MS instruments) from the source 301 is distributed into multiple ion beams by the distributor 308, which may be, for example, a slit RF channel. The ions then enter multiple channels of the 1D RFQ array 165. The 1D RFQ array 165 may be made by EDM for better precision and a small inscribed diameter of RFQ. Distribution of the ion current between multiple RFQ channels drops the ion current per channel, thus avoiding (or reducing) space-charge effects and the resulting beam expansion. Each of the RF-only ion guides 165 may have a small inscribed radius $R\leq 1$ mm and may be operated at elevated frequencies of, for example, 10 MHz and an amplitude of at least V=1 kV in order to form narrow ion beams. To keep parameter $q=4V*ze/m/R^2(2\ pi*F)^2<1$ at a low m/z of 100 amu, at R=1 mm and at high amplitude V=1 kV (o-p), higher frequencies of F=10 MHz are desired. The dynamic well in a RFQ is known to be $W(r)=(r/R)^2*q*V/4$. For an upper m/z of 2000 amu (q=0.05), the beam size in an RFQ may be estimated assuming $W(r)=kT$: $d=2R*(4\ kT/qVe)^{0.5}=0.1$ mm.

Ion beams may be extracted from the RFQ array 165 by a negative bias on skimmers, which form local crossovers near the skimmer plane. The planar optics 305 then provide ion beam spatial expansion while reducing angular divergence in the X-direction, say by 10-fold (e.g. in line with U.S. Pat. No. 8,895,920). Planar optics 365 allow mixing of multiple beams in the Y-direction, thus forming wide ion packets in the orthogonal accelerator 185, illustrated by the dark square.

Strong spatial compression of ion beams in the X-direction reduces the beam emittance, thus reducing the turn-around time and increasing the resolution in the MRTOF 190 or Re-TOF 220.

Figure 14:
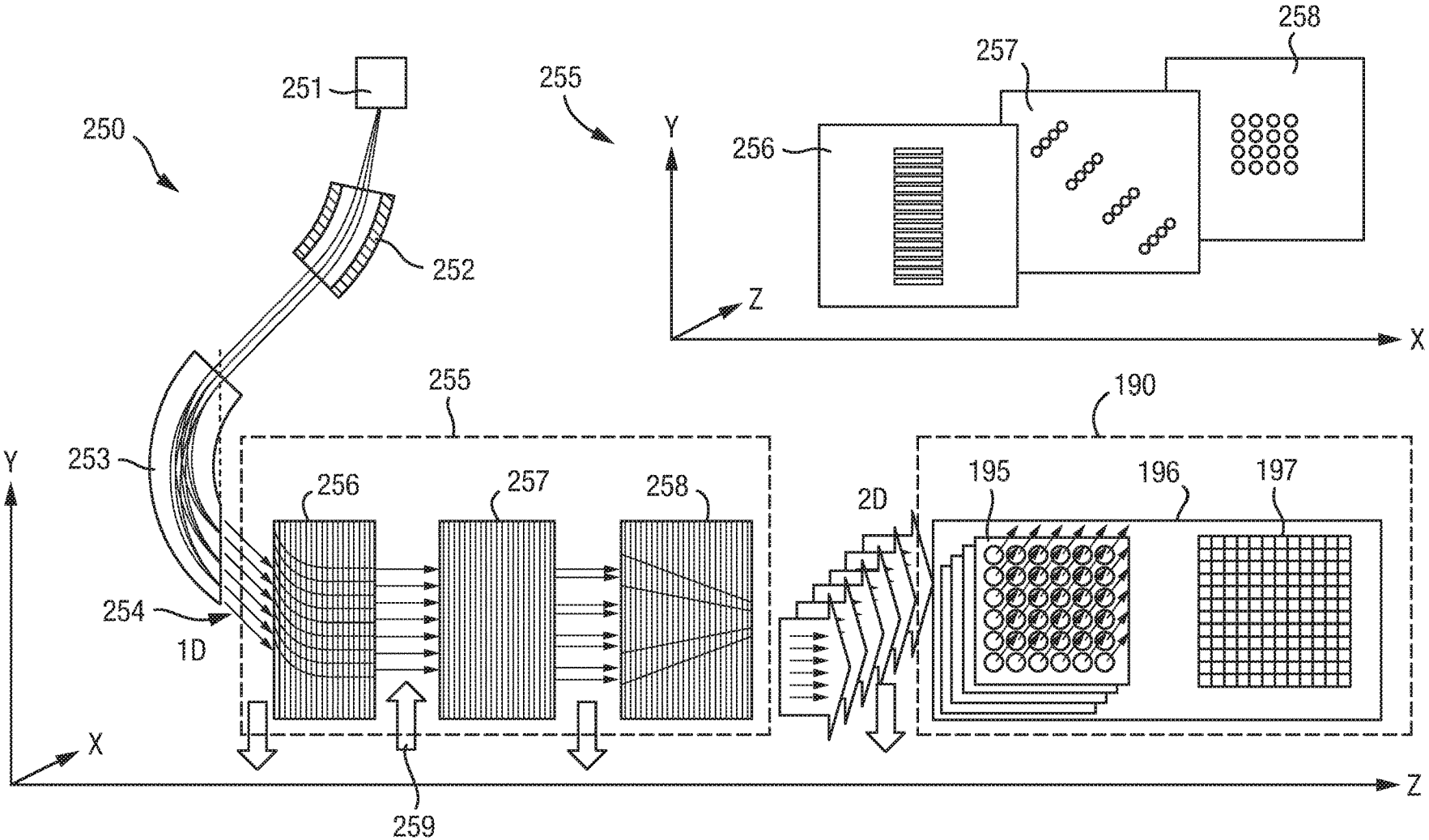
FIG. 14 illustrates an embodiment comprising a single ion source and a magnetic sector for converting the ion beam into an array of multiple ion beams of different mass to charge ratios.

FIG. 14 shows an embodiment 250 that may be used, for example, for parallel tandem MS-MS. The instrument comprises: an ion source 251, an electrostatic energy filter 252, a magnetic sector 253, an RF ion guide channel array 255 forming a dimensional converter for forming a 2D array of ion flows; and a 2D mapping MRTOF analyzer 190. In operation, ions are generated by the ion source 251 and pass through the electrostatic energy filter 252 and magnetic sector 253. The energy filter 252 and sector 253 separate the ions according to mass to charge ratio (in a direction substantially perpendicular to the flight paths of the ions) so as to form a 1D array of ion beams 254. The sector instrument may be a Mattauch-Herzog instrument for separating a relatively wide mass range. The resolution of the magnet sector mass separator may be about 100 so as to accept a relatively wide mass range (say 5:1), while using a static magnet. The magnetic sector instrument may be made from rare earth material magnetic plates. These features enable a moderate size and cost, and the use of a sub-keV acceleration energy to ease ion collection in the downstream RF array 255.

Multiple ion beams of different mass to charge ratios are transmitted from the magnetic sector 253 into the RF ion guide array 255. Within RF array 255, ion flows may be slowed down in gas collisions. The ions may be redistributed from a 1D array into a 2D flow array of ions by the dimensional converter. The dimensional converter is exemplified here by a series of RF arrays 256,257,258. RF array 256 has a column of slit-shaped channels. RF array 257 is configured to converge ions from the slit-shaped channels into apertures. RF array 258 converges ions from rows of apertures to a regular square pattern of apertures. RF voltages are applied to the arrays so as to repel ions from electrode walls by RF field confinement, thus converging the ions as described. The ions may therefore be transformed from a 1D array to a 2D array prior to mass analysis.

At least some of the ions may be fragmented. Ion beam array 254 may be slowed, downstream of the magnetic sector to a few tens of electron volts for enabling ion fragmentation in the RF array 255. The RF array 255 may serve as a CID or SID cell for tandem MS-MS analysis. One or more electrical potential, such as DC potentials, may be travelled along the RF array 255 in order to drive the ions through the device and/or to control the above-mentioned fragmentation that may take place.

The 2D array of ion beams is then mass analyzed in parallel with the 2D mapping MRTOF 190, thus providing comprehensive all-channel spectra. The 2D array of channels may have a larger number of channels than the 1D array 254. The system therefore dramatically enhances the analysis throughput by handling (e.g. fragmenting and analyzing) multiple ion beams in parallel.

As described above, the ions may be fragmented, at least some of the time, so as to produce spectral data for the fragment ions. It is contemplated that the instrument may repeatedly switch the fragmentation on and off (or repeatedly bypass the fragmentation) during a single experimental run so as to provide both MS data and MS/MS data. The parent ion data may then be correlated with the respective fragment ion data.

While tandem spectrometer 250 employs many standard MS components, differential pumping (shown by white arrows) appears the most challenging part for practical implementation. While the vacuum in a small size magnet sector has to be at least 1E-5 Tor, gas dampening in the RF guides requires at least 1E-2 tor. The gas load into magnet sector can be reduced by additional stage of differential pumping and/or using SID fragmentation (e.g. in cell 256) and/or using elongated RF channels in the fragmentation cell (e.g. cell 256) for reduced conductivity between gas supplied at port 259 and the magnetic sector.

The invention claimed is:

1. A time-of-flight mass spectrometer comprising:

an ion source array for supplying or generating ions at an array of positions;

a position sensitive ion detector having an array of separate detection regions configured such that ions received at different ones of the detection regions are determined as having originated from different positions in said array of positions; and ion optics arranged and configured to guide ions from the ion source array to the position sensitive detector so as to map ions from the array of positions on the ion source array to an array of positions on the position sensitive detector;

wherein the ion optics includes at least two ion mirrors for reflecting ions, at least one of which is a gridless ion mirror; wherein said two ion mirrors are spaced apart from each other in a first dimension (X-dimension) and are each elongated in a second dimension (Z-dimension) or along a longitudinal axis that is orthogonal to the first dimension; and wherein the spectrometer is configured such that the ions drift in the second dimension (Z-dimension) or along the longitudinal axis towards the detector as they are reflected between the mirrors;

further comprising an ion introduction mechanism for introducing packets of ions into the space between the mirrors such that they travel along a trajectory that is arranged at an angle to the first and second dimensions such that the ions repeatedly oscillate in the first dimension (X-dimension) between the mirrors as they drift through said space in the second dimension (Z-dimension).

2. The spectrometer of claim 1, wherein the step of mapping ions from the array of positions on the ion source array to the array of positions on the position sensitive detector comprises mapping ions from a 2D array of positions on the ion source array to a corresponding 2D array of positions on the position sensitive detector.

3. The spectrometer of claim 1, wherein said ion optics, including the at least two ion mirrors, are arranged and configured such that the ions are reflected by each of the mirrors and between the mirrors a plurality of times before reaching the detector.

4. The spectrometer of claim 1, wherein the ion introduction mechanism comprises an orthogonal ion accelerator for orthogonally accelerating ions into one of the ion mirrors.

5. The spectrometer of claim 1, wherein the ion optics comprise one or more ion optical lens through which the ions pass, in use, for focusing ions in a plane defined by the first and second dimensions (X-Z plane).

6. The spectrometer of claim 1, wherein the ion source array comprises a target plate and an ionizing device for generating at least one primary ion beam, at least one laser beam, or at least one electron beam for ionizing one or more analytical samples located on the target plate at said array of positions.

7. The spectrometer of claim 6, wherein the ionizing device is configured to direct one of the primary ion beams, laser beams or electron beams at each position in said array of positions at the ion source array; or wherein said at least one primary ion beam, at least one laser beam or at least one electron beam is continuously scanned or stepped between different positions of said array of positions on the target plate; or wherein each position of the different positions of said array of positions on the target plate comprises an area, and wherein said at least one primary ion beam, at least one laser beam or at least one electron beam is continuously scanned or stepped across different portions of said area.

8. The spectrometer of claim 1, wherein the ion source array comprises a single ion source for generating ions and an ion divider for dividing or guiding the ions generated by the ion source to the array of positions on the ion source array.

9. The spectrometer of claim 1, further comprising an electrostatic sector for guiding ions from the ion source array downstream towards the ion mirrors; and/or comprising an electrostatic sector for guiding ions from the ion mirrors downstream towards the detector.

10. The spectrometer of claim 1, further comprising an array of quadrupoles, ion guides or ion traps configured so that ions generated or supplied at different positions, in said array of positions on the ion source array, are transmitted into different quadrupoles, ion guides or ion traps in said array of quadrupoles, ion guides or ion traps.

11. The spectrometer of claim 10, wherein the spectrometer is configured to apply electrical potentials at the exits of the quadrupoles, ion guides or ion traps so as to trap and release ions from the quadrupoles, ion guides or ion traps in a pulsed manner downstream towards the detector.

12. The spectrometer of claim 1, wherein the ion source array comprises an ion source and an ion guide configured to receive ions from the ion source and to guide ions received from the ion source at different times to different positions in said array of positions at the ion source.

13. The spectrometer of claim 12, wherein an ion separator is provided between the ion source and ion guide for separating ions according to a physicochemical property such that ions having different values of said physicochemical property are guided to different positions in said array of positions at the ion source.

14. The spectrometer of claim 1, further comprising a fragmentation or reaction device downstream of the ion source array for fragmenting the ions to produce fragment ions or for reacting the ions with reagent ions or molecules so as to form product ions; and wherein said detector or another detector is provided to detect the fragment or product ions.

15. The spectrometer of claim 14, wherein the spectrometer is configured to repeatedly switch the fragmentation or reaction device between a first fragmentation or reaction mode that provides a high level of fragmentation or reaction and a second fragmentation or reaction mode that provides a lower level or no fragmentation or reaction, during a single experimental run; and/or wherein the spectrometer is configured to repeatedly switch between a first mode in which ions are fragmented or reacted in the fragmentation or reaction device and a second mode in which ions bypass the fragmentation or reaction device, during a single experimental run.

16. A time-of-flight mass spectrometer comprising:

an ion source array for supplying or generating ions at an array of positions;

a position sensitive ion detector having an array of separate detection regions configured such that ions received at different ones of the detection regions are determined as having originated from different positions in said array of positions; and ion optics arranged and configured to guide ions from the ion source array to the position sensitive detector so as to map ions from the array of positions on the ion source array to an array of positions on the position sensitive detector;

wherein the ion optics include a gridless ion mirror for reflecting ions and an electrostatic or magnetic sector for receiving ions and guiding the ions into the gridless ion mirror; wherein the gridless ion mirror and the electrostatic or magnetic sector are configured such that the ions are transmitted from the electrostatic or magnetic sector into the ion mirror a plurality of times such that the ions are reflected by said ion mirror a plurality of times.

17. A method of time-of-flight mass spectrometry comprising:

providing a time-of-flight mass spectrometer as claimed in claim 16;

supplying or generating ions at an array of positions on an ion source array; and using the ion optics to guide ions from the ion source array to the position sensitive detector so as to map ions from the array of positions on the ion source array to an array of positions on the position sensitive detector; and determining that ions received at different ones of the detection regions on the position sensitive detector have originated from different positions in said array of positions on the ion source array;

wherein ions are reflected from the ion mirror into the electrostatic or magnetic sector and are transmitted from the electrostatic or magnetic sector into each of the ion mirrors a plurality of times such that the ions are reflected by each ion mirror a plurality of times.

18. A method of time-of-flight mass spectrometry comprising:

supplying or generating ions at an array of positions on an ion source array;

providing a position sensitive ion detector having an array of separate detection regions;

using ion optics to guide ions from the ion source array to the position sensitive detector so as to map ions from the array of positions on the ion source array to an array of positions on the position sensitive detector; and determining that ions received at different ones of the detection regions in the position sensitive detector have originated from different positions in said array of positions;

wherein the ion optics includes two ion mirrors that reflect ions, at least one of which is a gridless ion mirror; wherein said two ion mirrors are spaced apart from each other in a first dimension (X-dimension) and are each elongated in a second dimension (Z-dimension) or along a longitudinal axis that is orthogonal to the first dimension; and wherein packets of ions are introduced into the space between the ion mirrors such that they travel along a trajectory that is arranged at an angle to the first and second dimensions such that the ions repeatedly oscillate in the first dimension (X-dimension) between the mirrors as they drift in the second dimension (Z-dimension) or along the longitudinal axis towards the detector.

19. The method of claim 18, wherein the ions are reflected multiple times by each of said ion mirrors.

* * * * *